US006167974B1

(12) United States Patent
Webb

(10) Patent No.: US 6,167,974 B1
(45) Date of Patent: Jan. 2, 2001

(54) METHOD OF UNDERBALANCED DRILLING

(75) Inventor: Alan B. Webb, Fort Worth, TX (US)

(73) Assignee: Halliburton Energy Services, Inc., Dallas, TX (US)

( * ) Notice: Under 35 U.S.C. 154(b), the term of this patent shall be extended for 0 days.

(21) Appl. No.: 09/149,531

(22) Filed: Sep. 8, 1998

(51) Int. Cl.[7] ..... E21B 34/14
(52) U.S. Cl. ..... 175/57; 175/318; 175/324
(58) Field of Search ..... 175/57, 317, 318, 175/324; 166/332.4, 332.5, 332.8, 386

(56) References Cited

U.S. PATENT DOCUMENTS

| | | | | |
|---|---|---|---|---|
| 2,162,578 | * | 6/1939 | Hacker | 166/332.8 |
| 3,414,060 | * | 12/1968 | Zak | 166/332.5 |
| 4,928,772 | * | 5/1990 | Hopmann | 166/386 |
| 5,145,005 | | 9/1992 | Dollison | 166/334 |
| 5,375,659 | | 12/1994 | Gilbert et al. | 166/264 |
| 5,479,989 | | 1/1996 | Shy et al. | 166/332.4 |
| 5,564,502 | | 10/1996 | Crow et al. | 166/386 |
| 5,682,921 | | 11/1997 | Rawson et al. | 137/527.6 |
| 5,810,087 | * | 9/1998 | Patel | 166/373 |

FOREIGN PATENT DOCUMENTS 2318817A 5/1998 (GB) .

OTHER PUBLICATIONS

"Underbalanced Completions Improve Well Safety and Productivity", World Oil, Nov., 1995.
"Underbalanced Drilling and Completion Manual" Maurer Engineering, Oct., 1996.

* cited by examiner

*Primary Examiner*—Hoang Dang
(74) *Attorney, Agent, or Firm*—William M. Imwalle; Marlin R. Smith

(57) ABSTRACT

Apparatus and associated methods are provided which facilitate underbalanced drilling and completion of wells. In a described embodiment of a well control valve, the valve is opened and closed when a drill string is displaced therethrough. A shifting device is carried on a drill bit and deposited in the valve when the drill string enters and opens the valve. The valve is closed and the shifting device is retrieved from the valve when the drill string is tripped out of the well. A packer hydraulic setting tool usable in conjunction with the well control valve in underbalanced completions is also provided.

11 Claims, 40 Drawing Sheets

METHOD OF UNDERBALANCED DRILLING

BACKGROUND OF THE INVENTION

The present invention relates generally to operations performed in subterranean wells and, in an embodiment described herein, more particularly provides apparatus and methods for underbalanced drilling and completion of wells.

There are several recognized advantages to drilling and completing a well in an underbalanced condition, that is, in a condition in which fluid pressure in a wellbore is less than fluid pressure in a formation intersected by the wellbore. For example, the underbalanced condition prevents fluid loss from the wellbore into the formation and prevents some types of damage to the formation which may be caused by infiltration of the wellbore fluid into the formation. An overview of underbalanced completion practices and their advantages may be found in an article entitled "Underbalanced Completions Improve Well Safety and Productivity" by Tim Walker and Mark Hopmann (*World Oil,* November, 1995), which is incorporated herein by this reference.

Unfortunately, apparatus and methods which facilitate convenient, economical and safe underbalanced well operations are not presently widely available. For example, currently available apparatus designed to permit safe tripping in and out of drill strings and production tubing strings rely either on complex, expensive and unreliable mechanisms or on adapted surface-controlled devices, such as subsurface safety valves, which must be installed relatively near the surface or face a significant risk of damage to control lines attached thereto if installed relatively deep in the well. Thus, a need exists for apparatus which will safely and conveniently facilitate underbalanced well operations.

In particular, a need exists for a well control valve which is operable upon passage of a tool therethrough. The tool may be attached to a drill string, production tubing string, or other conveyance. In this manner, the valve may isolate a formation intersected by a wellbore in an underbalanced condition from the remainder of the wellbore while the tubular string is tripped in or out of the wellbore. The valve should be capable of being installed near the formation, without compromising its operability or reliability.

Where the valve is operated by applying a biasing force to the valve via a tubular string, and the tubular string includes a packer, the packer should be prevented from prematurely setting in the wellbore due to application of the biasing force. Therefore, it would be highly desirable to provide a packer setting tool which prevents premature setting of the packer, while also facilitating use of the packer in underbalanced well operations.

SUMMARY OF THE INVENTION

In carrying out the principles of the present invention, in accordance with an embodiment thereof, a well control valve and a packer setting tool are provided. The well control valve isolates one portion of a wellbore from the remainder of the wellbore, and does not require surface controls. The packer setting tool is hydraulically actuatable and prevents premature setting of a mechanical set packer attached thereto. Methods of underbalanced drilling and completion of wells are also provided.

The well control valve utilizes a colleted latch sleeve assembly which is displaceable in the valve to control opening and closing of a closure assembly. When a tool, such as a drill bit, is conveyed into the valve, a shifting device releasably secured on the tool engages the latch sleeve assembly. Further displacement of the tool causes displacement of the latch sleeve assembly to operate the closure assembly. When the closure assembly has been operated, the shifting device is released from the tool and deposited within the valve.

The packer setting tool includes an isolation sleeve which prevents fluid communication between an internal flow passage of the setting tool and a chamber in fluid communication with a setting piston. The packer setting tool also includes a circulation sleeve which permits fluid communication between the flow passage and the exterior of the setting tool, thereby permitting circulation through the setting tool when it is interconnected in a tubular string. A plugging device may be installed in the setting tool when it is desired to set a packer attached to the setting tool. Fluid pressure applied to the plugging device displaces the isolation sleeve, thereby permitting fluid communication between the flow passage and the chamber and permitting the packer to be set thereby, and displacing the circulation sleeve, thereby preventing circulation through the setting tool and permitting the packer to be tested after it is set.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1A:
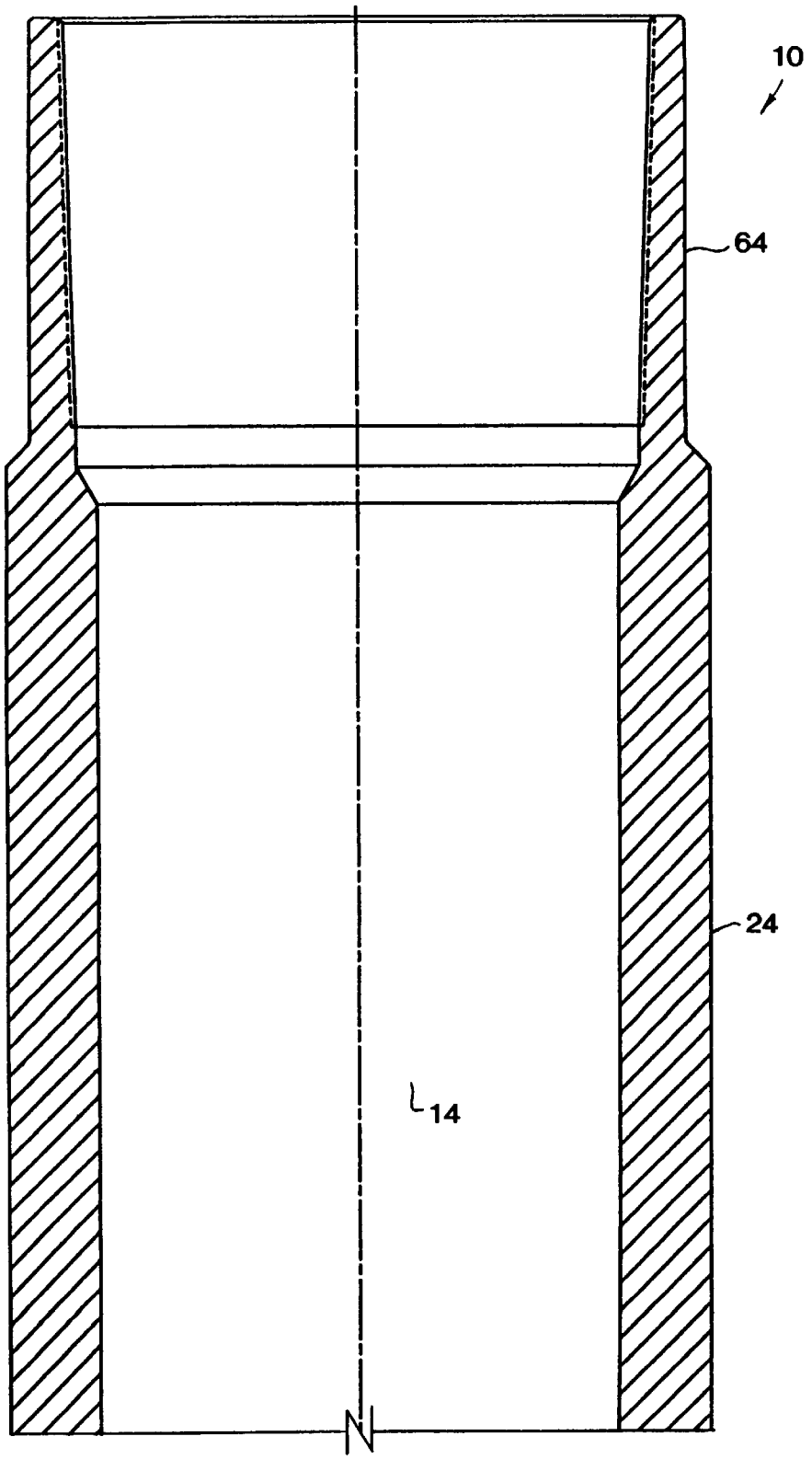
FIGS. 1A–I are cross-sectional views of successive axial portions of a well control valve embodying principles of the present invention, the valve being shown in open and closed configurations thereof.

Representatively illustrated in FIGS. 1A–I is a well control valve 10 which embodies principles of the present invention. In the following description of the valve 10 and other apparatus and methods described herein, directional terms, such as "above", "below", "upper", "lower", "upward", "downward", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The left-hand side of the FIGS. 1A–I depicts the valve 10 in a closed configuration, and the right-hand side of the FIGS. 1A–I depicts the valve in an open configuration. In the closed configuration, a closure assembly 12 of the valve 10 prevents fluid flow through an internal axial flow passage 14 formed therethrough. In the open configuration, the closure assembly 12 permits such fluid flow through the flow passage 14.

The closure assembly 12 is similar to a conventional flapper-type closure utilized in subsurface safety valves. A flapper 16 is pivotably mounted relative to a seat 18 circumscribing the flow passage 14. A torsion spring 20 biases the flapper 16 toward the seat 18. The flapper 16 is shown in FIG. 1I in its open position in solid lines, and in its closed position in dashed lines.

The flapper 16 is displaced between its open and closed positions by displacement of an operator sleeve assembly 22 relative thereto. To open the valve 10, the operator sleeve assembly 22 is displaced downwardly relative to an outer housing assembly 24 and pivots the flapper 16 away from the seat 18 against the biasing force of the spring 20. The operator sleeve assembly 22 is shown in its downwardly disposed position on the right-hand side of FIGS. 1A–I. The operator sleeve assembly 22 is displaced upwardly relative to the housing assembly 24 to permit the spring 20 to close the flapper 16 against the seat 18 to close the valve 10. The operator sleeve assembly 22 is shown in its upwardly disposed position on the left-hand side of FIGS. 1A–I.

Displacement of the operator sleeve assembly 22 between its upwardly and downwardly disposed positions is controlled by a colleted latch sleeve assembly 26. As will be described more fully below, the latch sleeve assembly 26 is initially in an upwardly disposed position relative to the operator sleeve assembly 22 when the valve 10 is run into a well, a generally C-shaped snap ring 28 carried on an upper portion of the operator sleeve assembly being engaged in a lower annular recess 30 formed externally on the latch sleeve assembly. However, when the latch sleeve assembly 26 is downwardly displaced relative to the operator sleeve assembly 22, the snap ring 28 is permitted to radially expand and disengage from the recess 30 and engage an upper annular recess 32 formed externally on the latch sleeve assembly. Thereafter, the latch sleeve assembly 26 and operator sleeve assembly 22 displace with each other. At this point, the latch sleeve assembly 26 is operatively engaged with the operator sleeve assembly 22, displacement of the latch sleeve assembly causing displacement of the operator sleeve assembly.

Displacement of the latch sleeve assembly 26 relative to the housing assembly 24 is performed by applying a force to a generally ring-shaped shifting device 34. As will be described in more detail below, the ring 34 is initially conveyed into the valve 10 releasably secured to a tool, such as a drill bit, the ring engages a shoulder 36 formed internally in the latch sleeve assembly 26, a downwardly biasing force is applied to the ring to shift the latch sleeve assembly downward relative to the housing assembly 24 so that the snap ring 28 engages the upper recess 32, and then a downwardly biasing force is applied to release the ring from the tool and deposit the ring in the latch sleeve assembly 26 as shown in FIGS. 1C&D. When the tool is later conveyed upwardly through the valve 10, the tool engages the ring 34 and displaces it upwardly therewith, the ring engages a radially expandable of shoulder 38 formed internally in the latch sleeve assembly 26, an upwardly biasing force is applied to the ring to shift the latch sleeve assembly and operator sleeve assembly 22 upward relative to the housing assembly 24, and the shoulder 38 then expands to permit the ring to be retrieved with the tool.

Figure 5A:
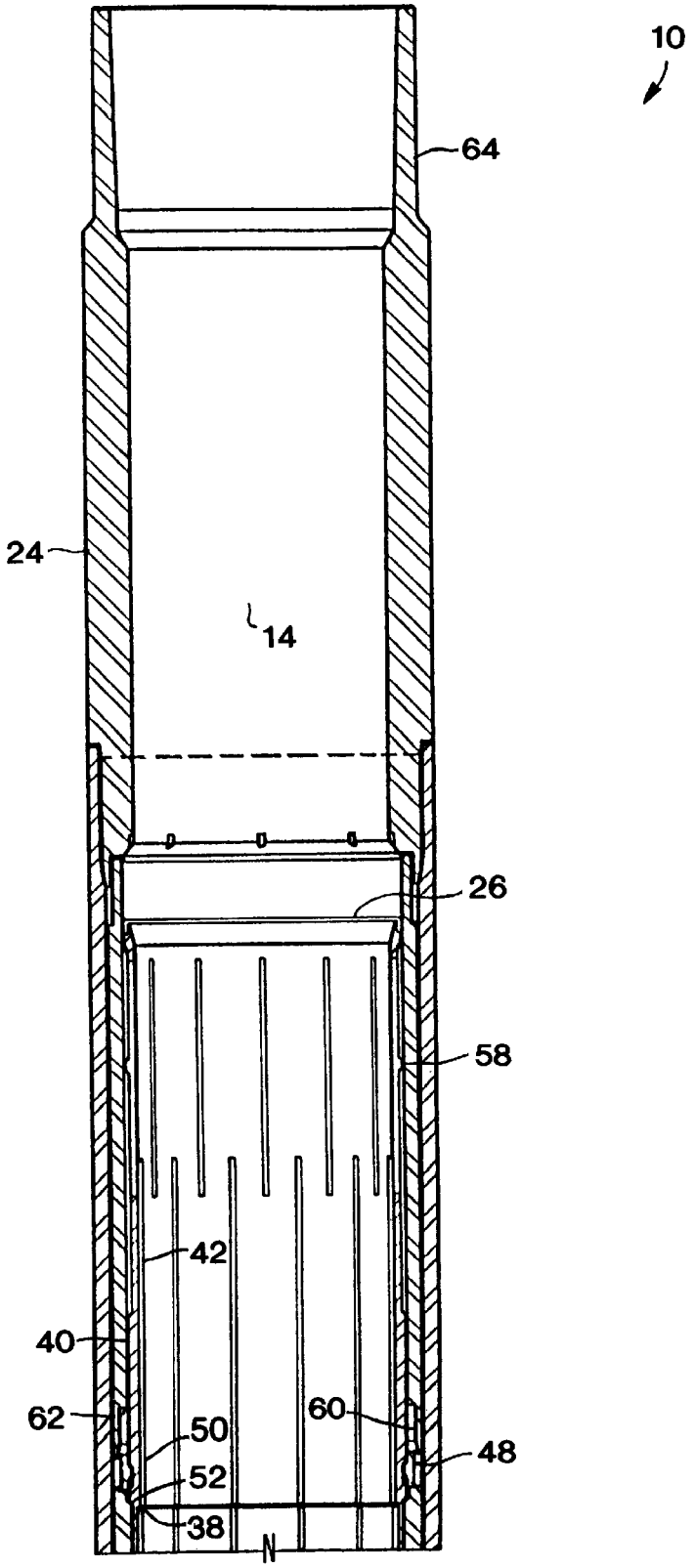
FIGS. 5A–E are cross-sectional views of successive axial portions of the well control valve of FIGS. 1A–I, the valve being shown in a locked open configuration in which it is run into a well.
Figure 5B:
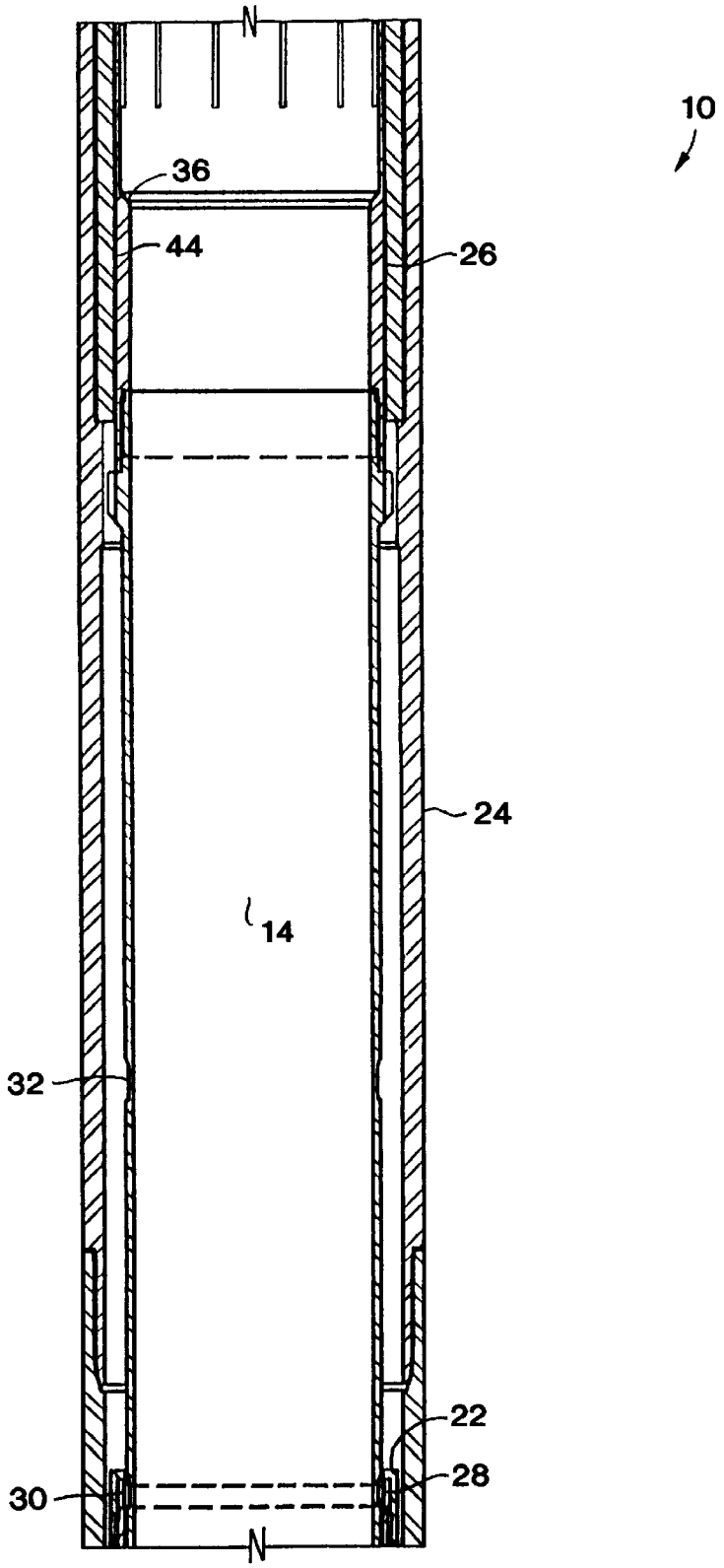
Figure 5C:
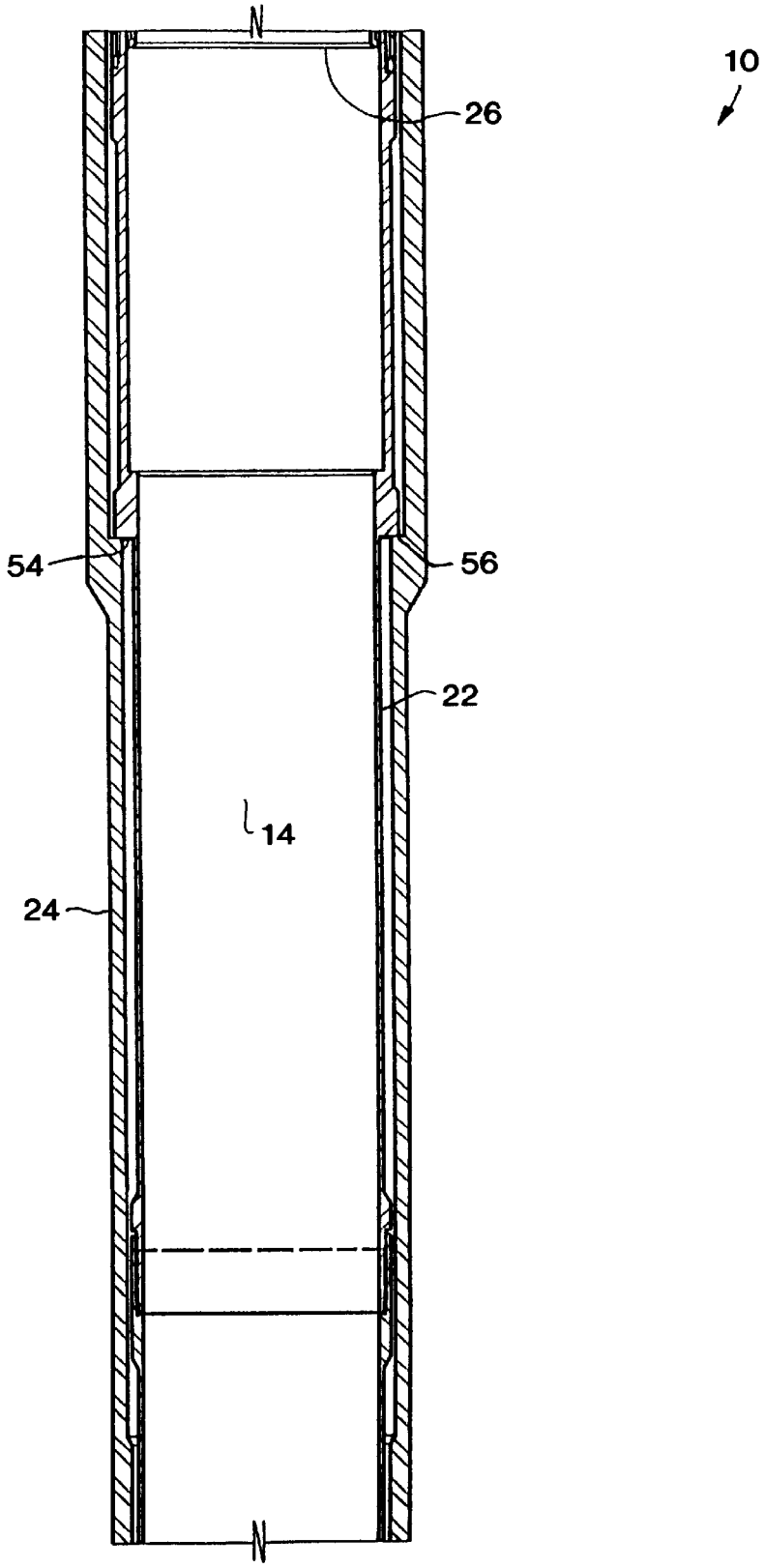
Figure 5D:
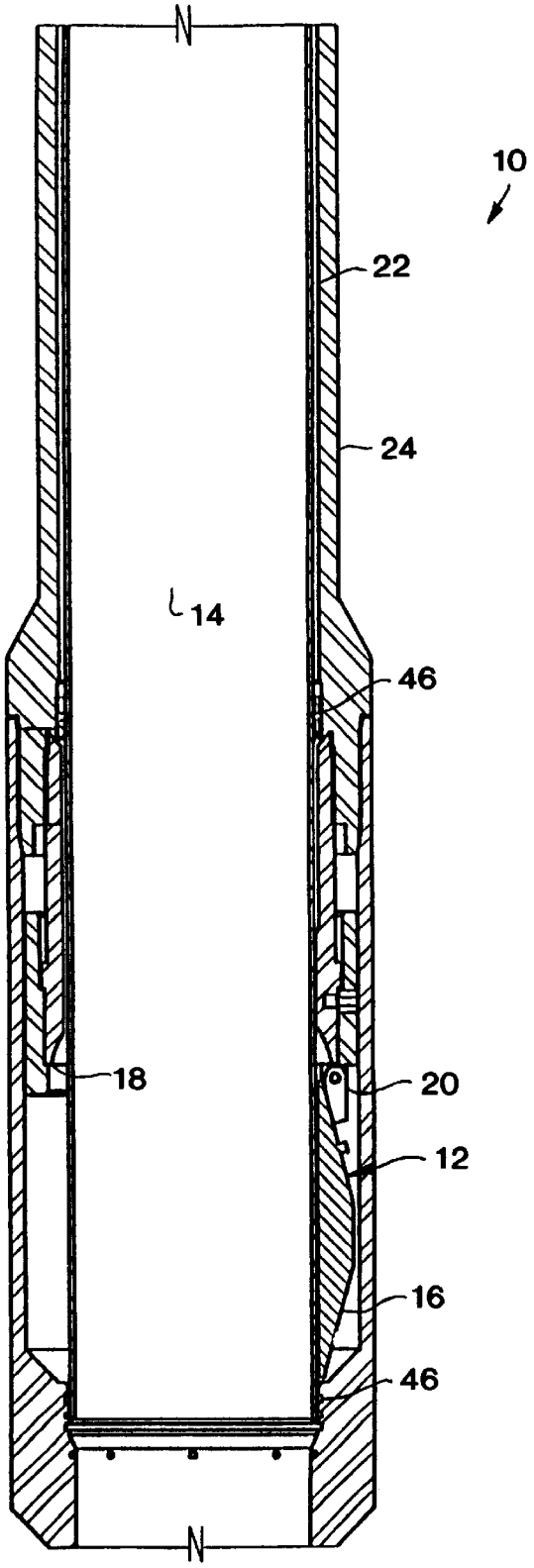
Figure 5E:
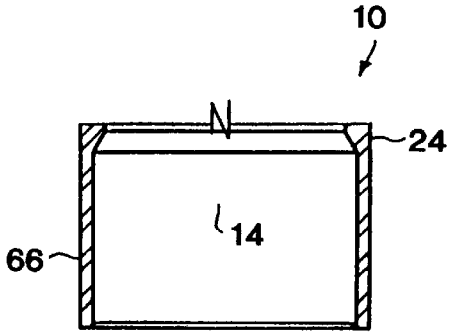
Figure 6A:
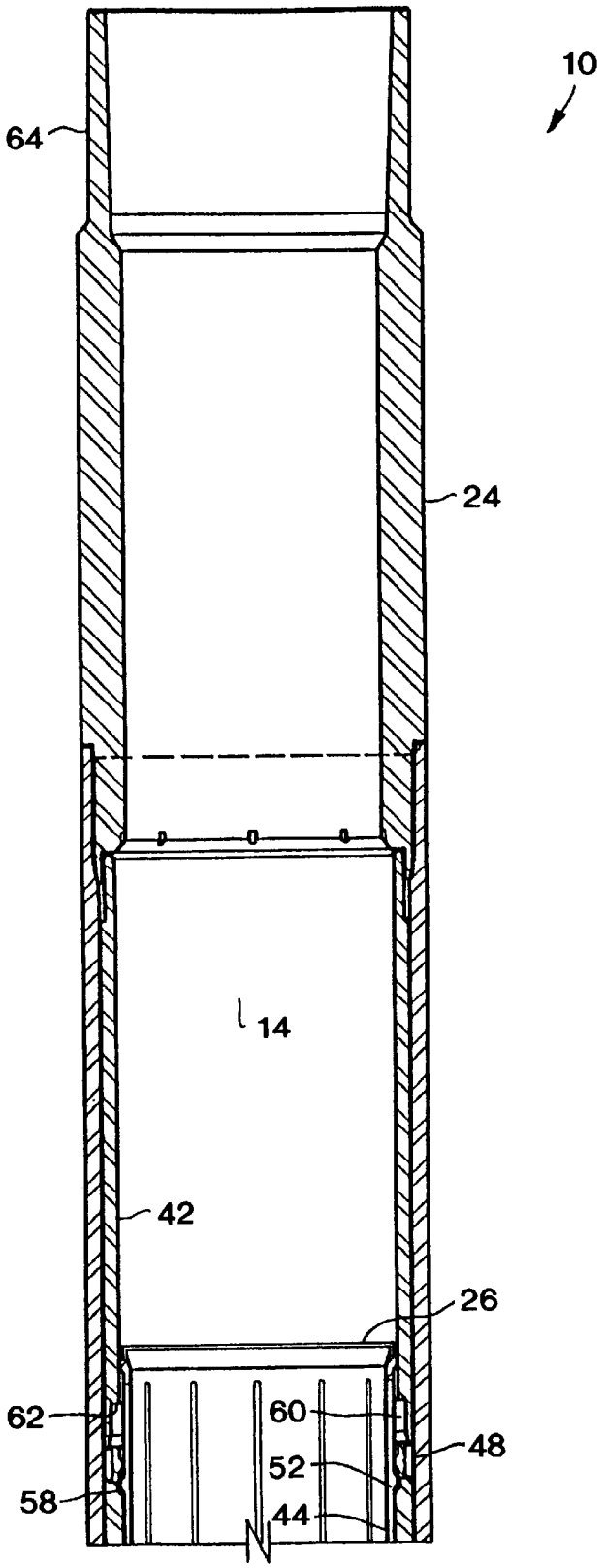
FIGS. 6A–E are cross-sectional views of successive axial portions of the well control valve of FIGS. 1A–I, the valve being shown in an open configuration after a latch sleeve assembly therein has been shifted.
Figure 6B:
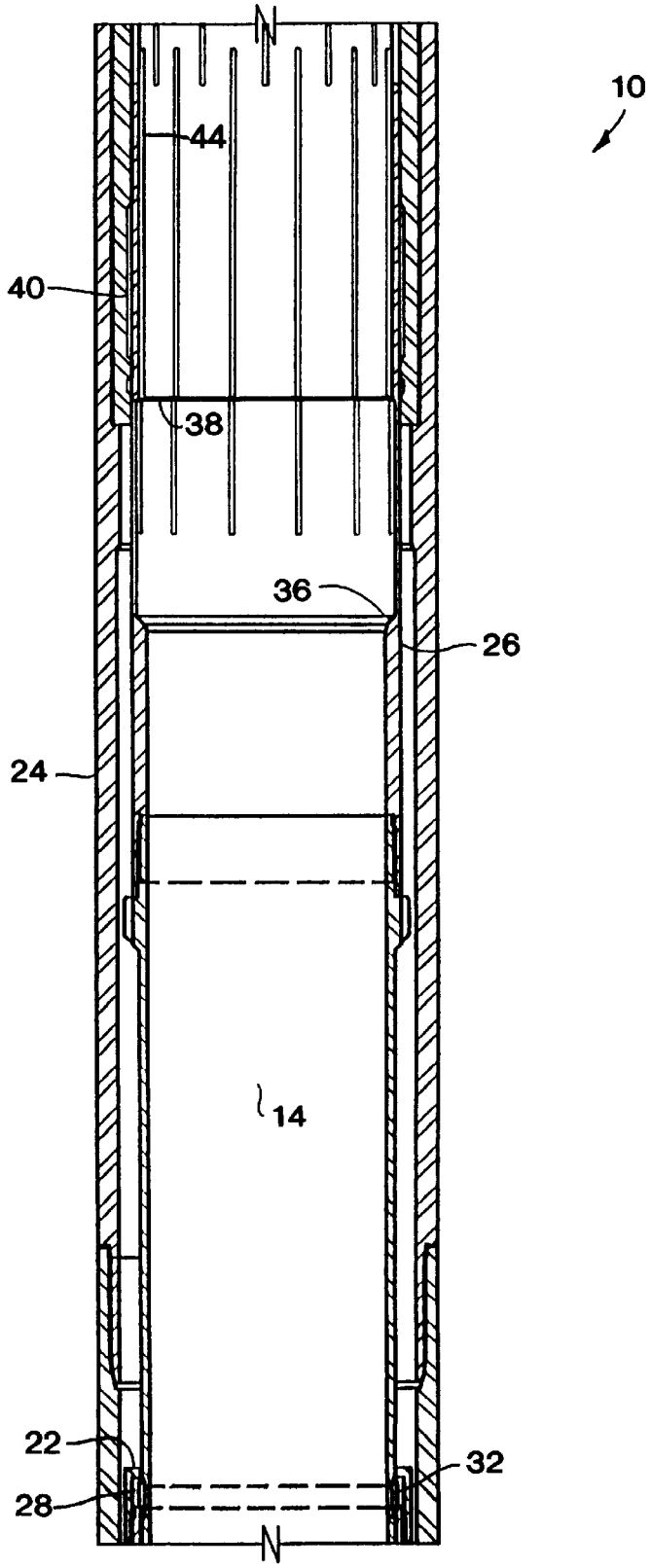
Figure 6C:
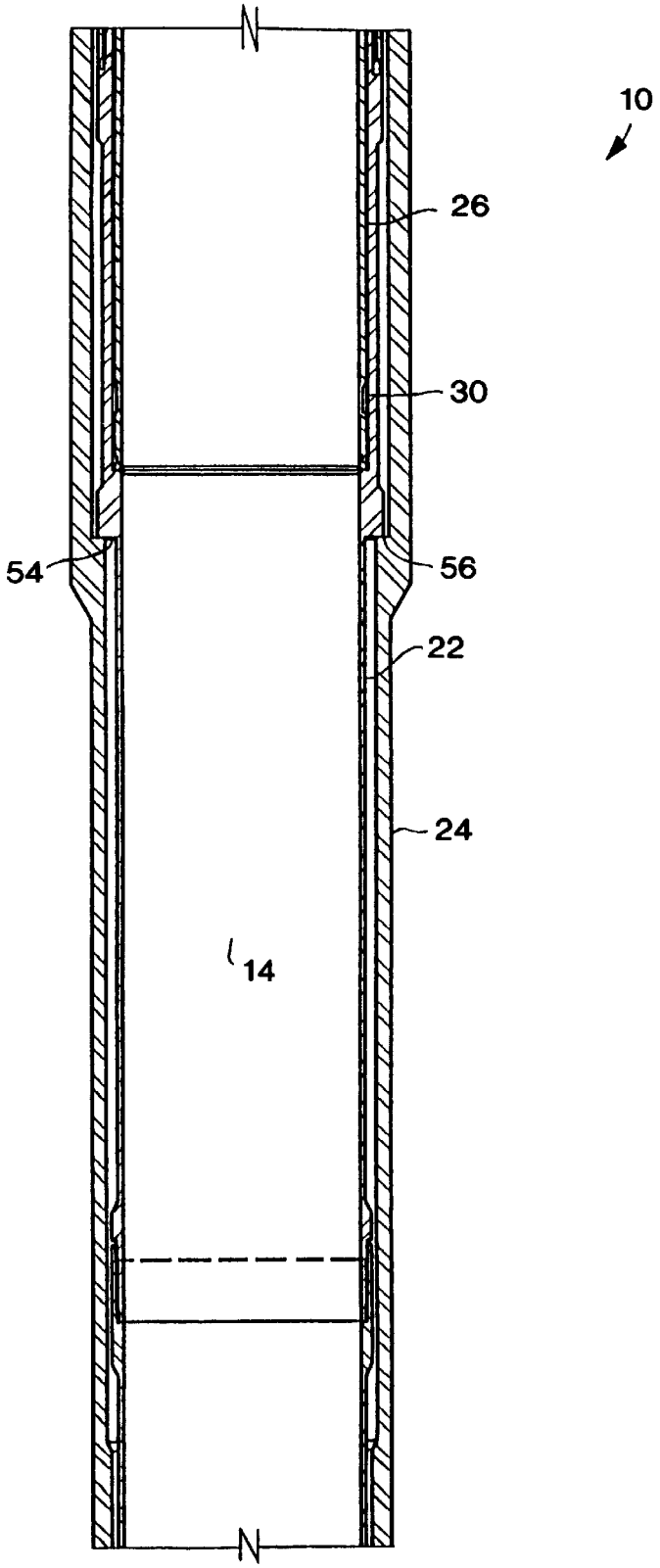
Figure 6D:
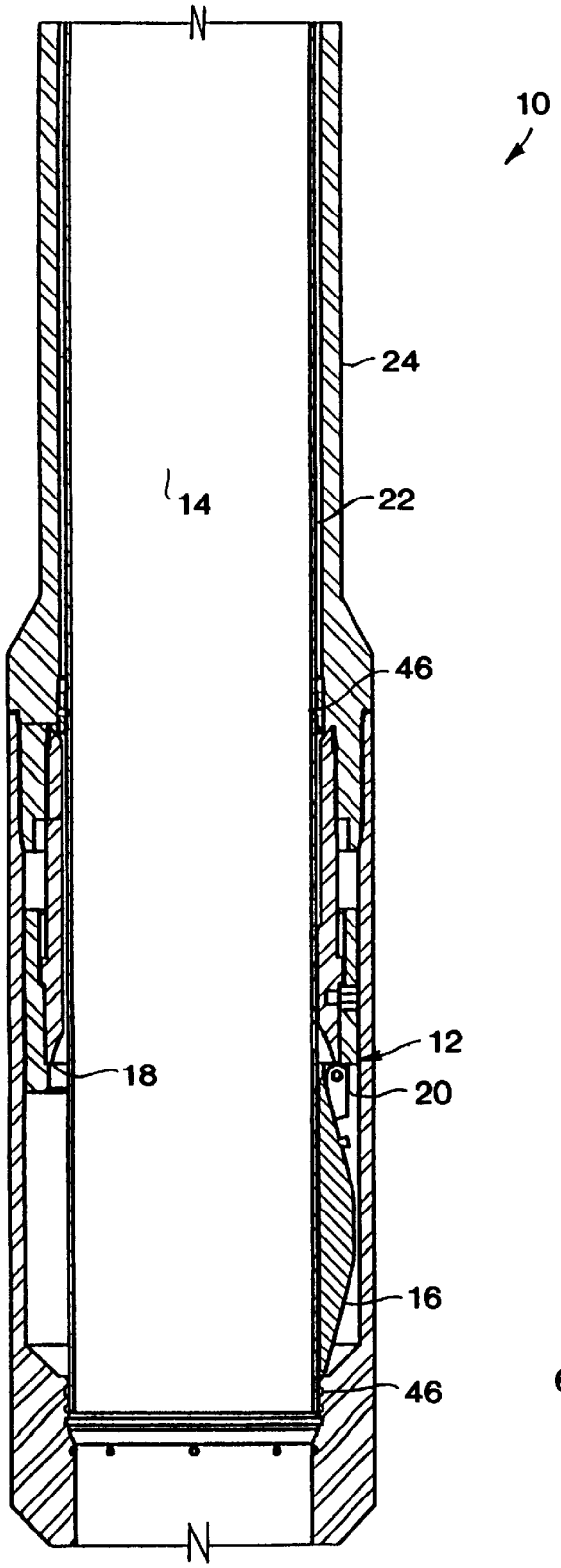
Figure 6E:
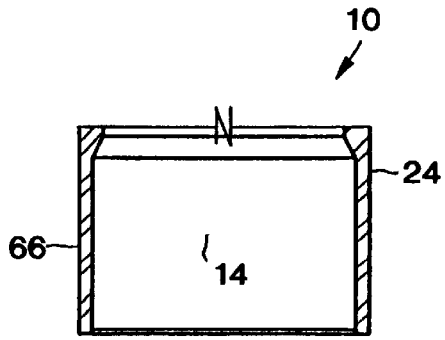
Figure 7A:
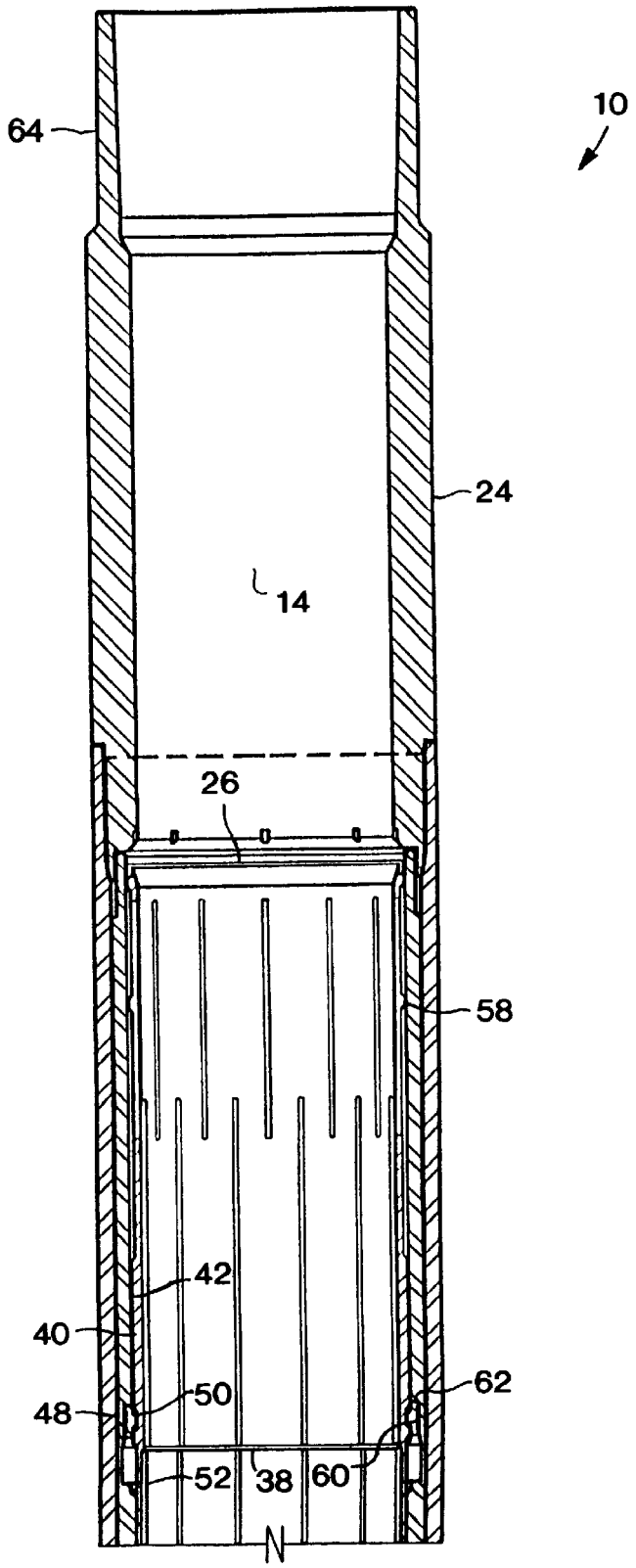
FIGS. 7A–E are cross-sectional views of successive axial portions of the well control valve of FIGS. 1A–I, the valve being shown in a closed configuration thereof.
Figure 7B:
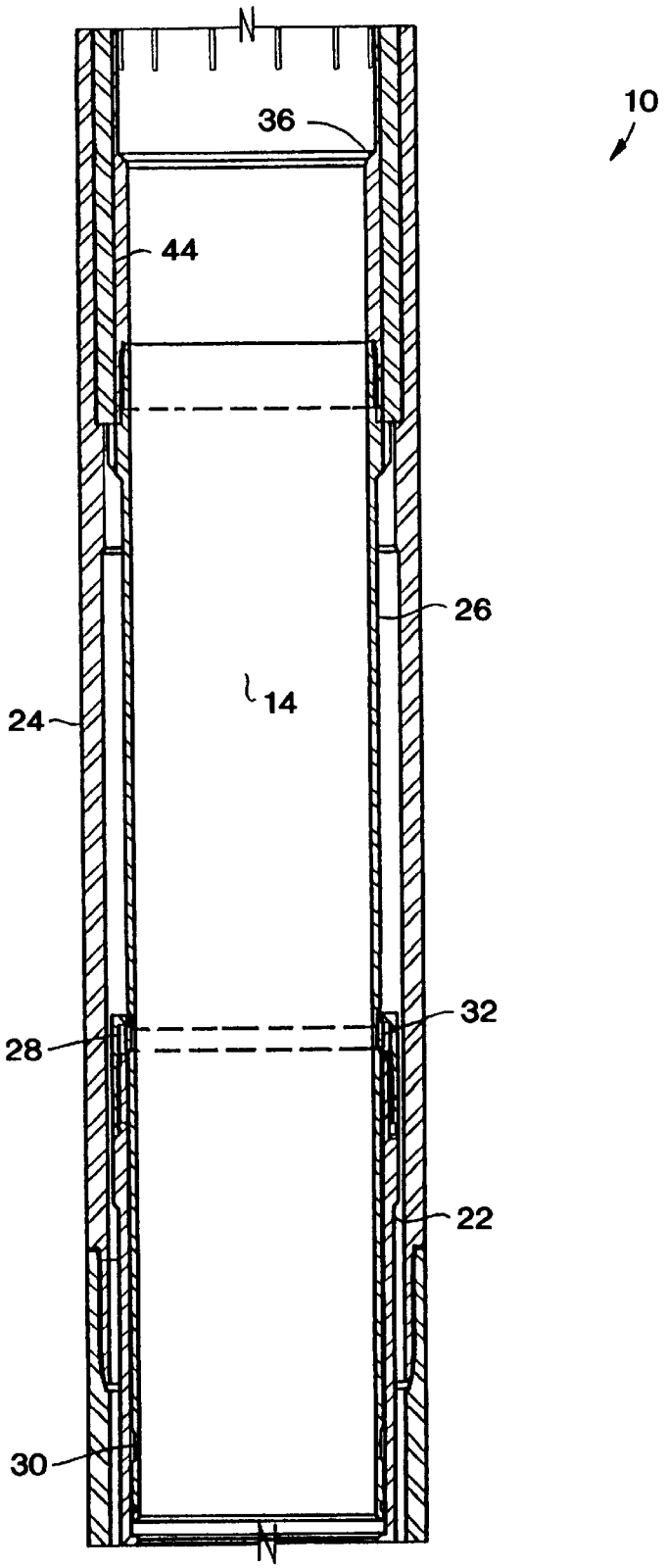
Figure 7C:
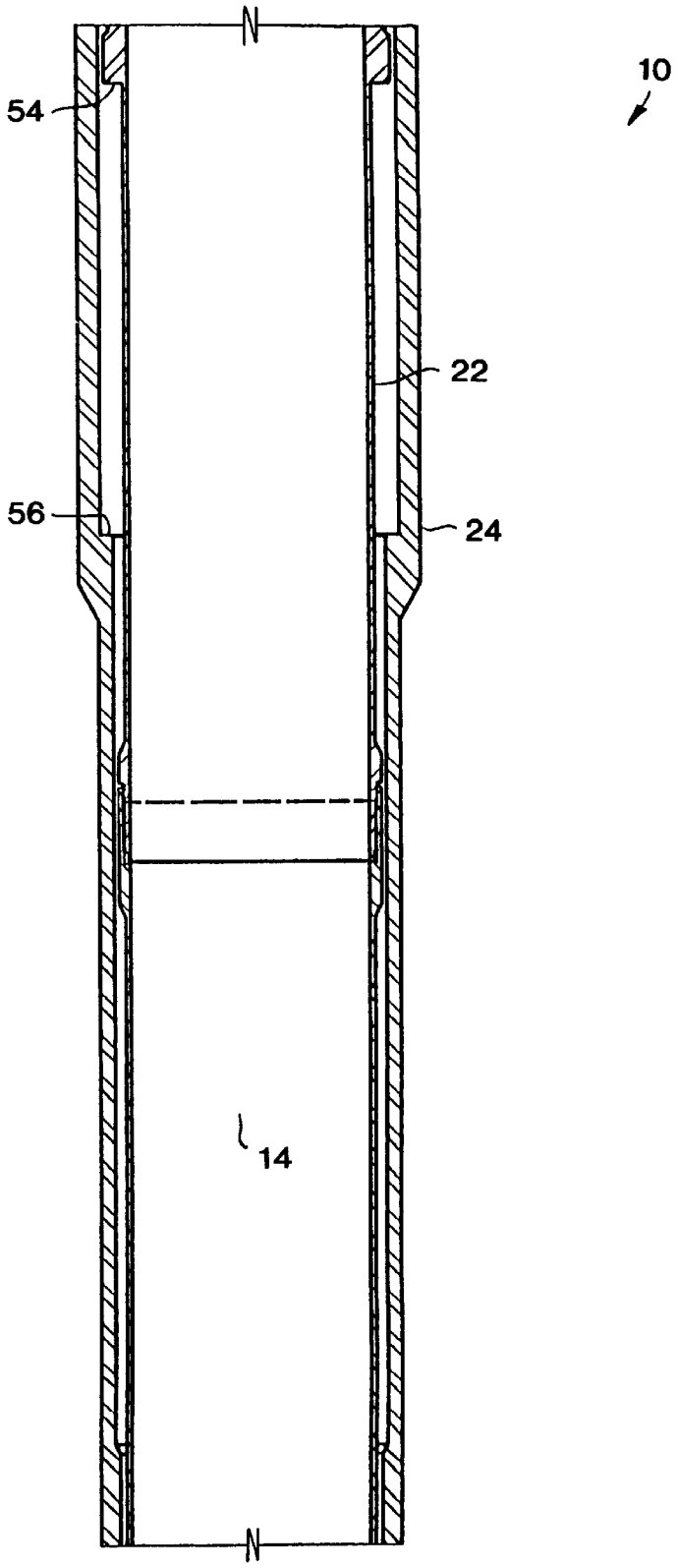
Figure 7D:
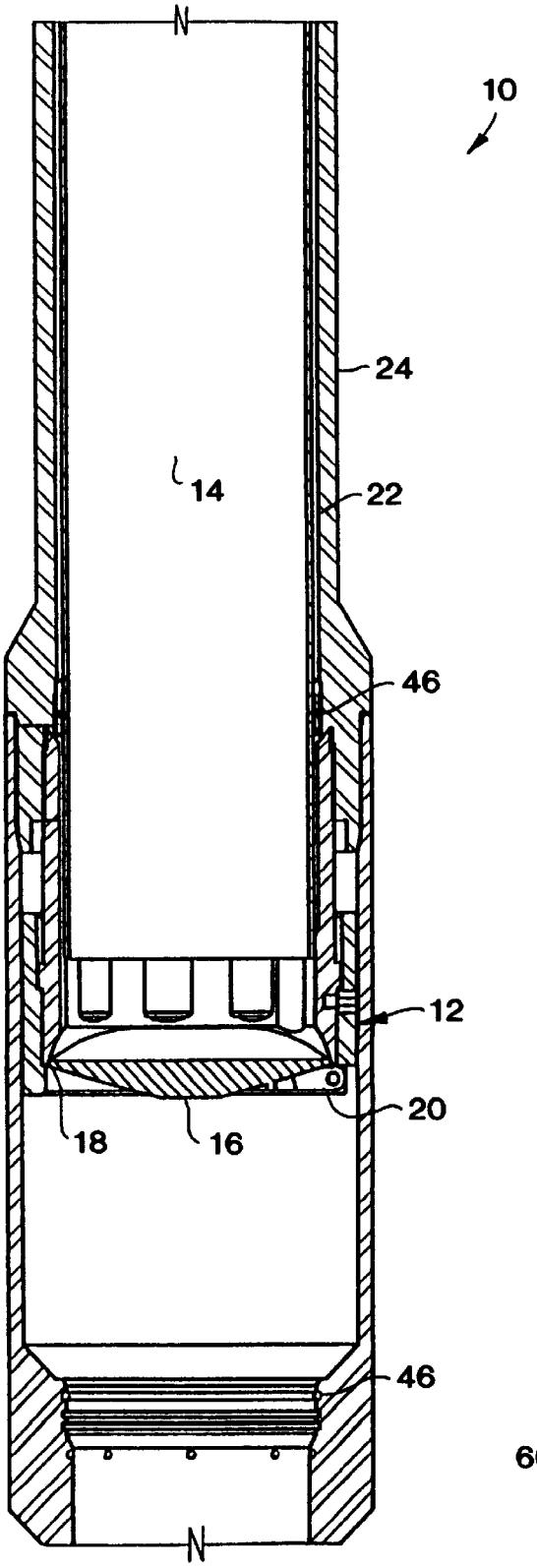
Figure 7E:
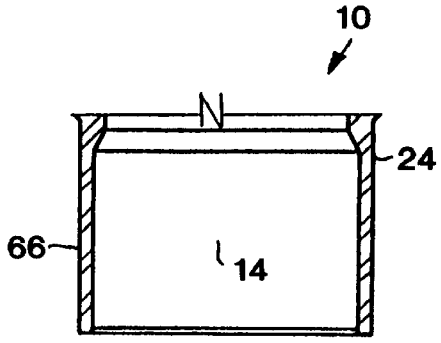
Figure 8A:
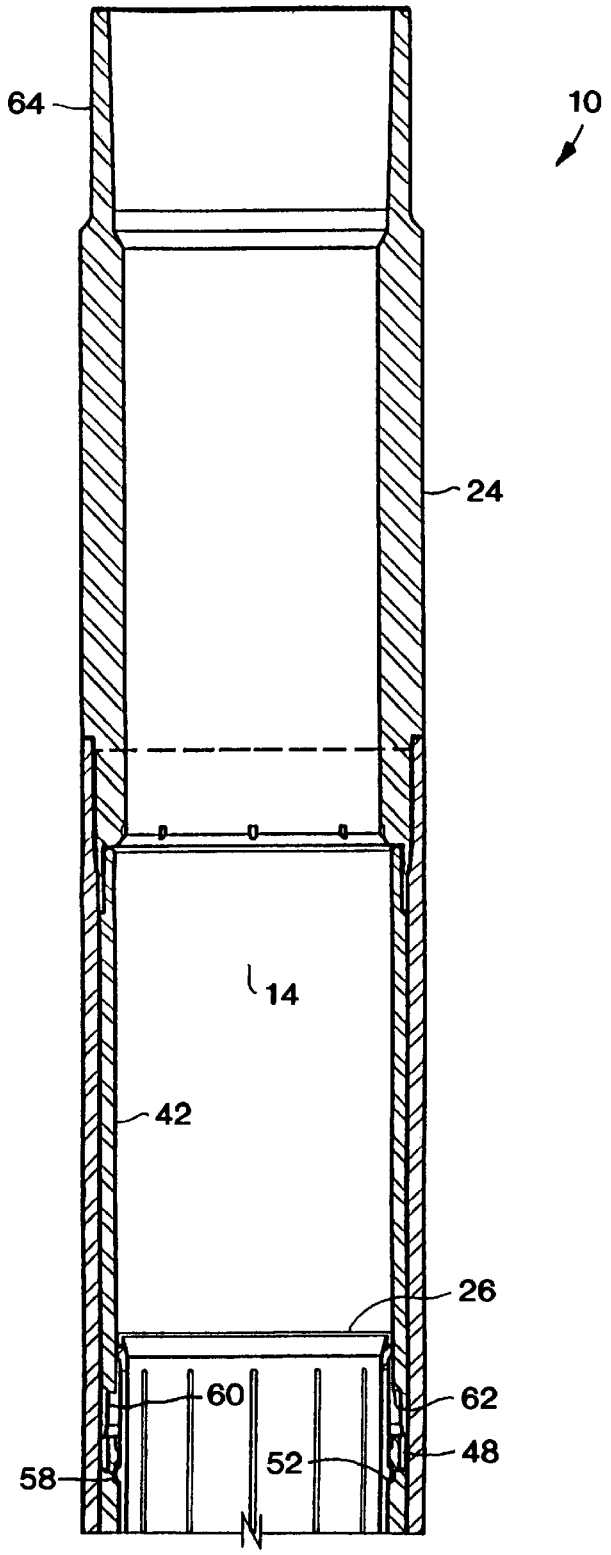
FIGS. 8A–E are cross-sectional views of successive axial portions of the well control valve of FIGS. 1A–I, the valve being shown in a reopened configuration thereof.
Figure 8B:
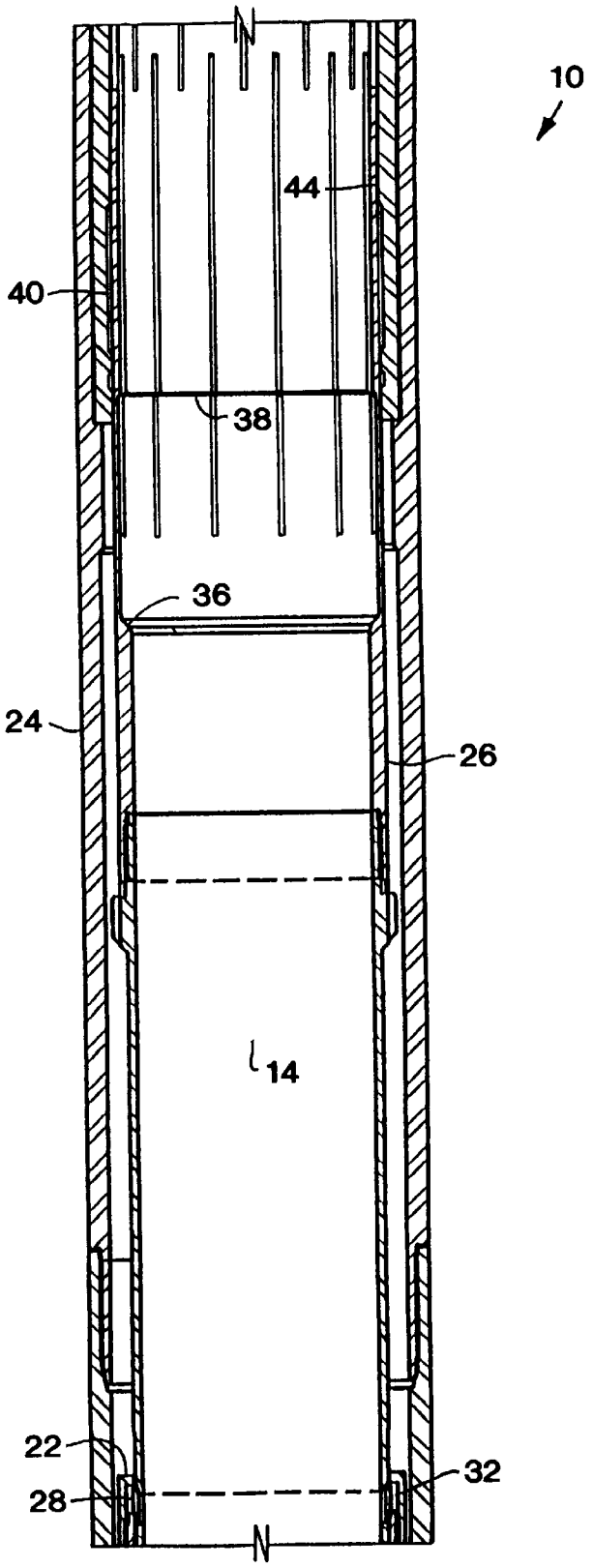
Figure 8C:
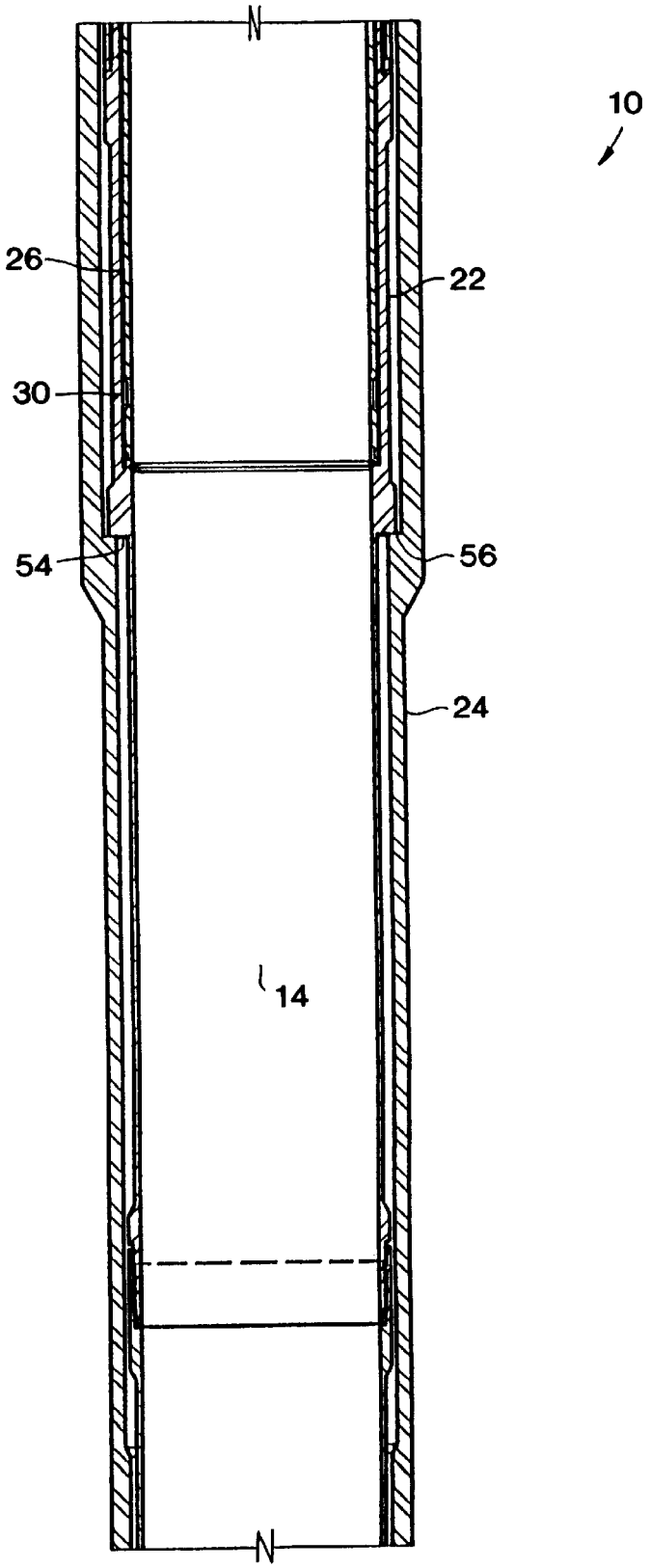
Figure 8D:
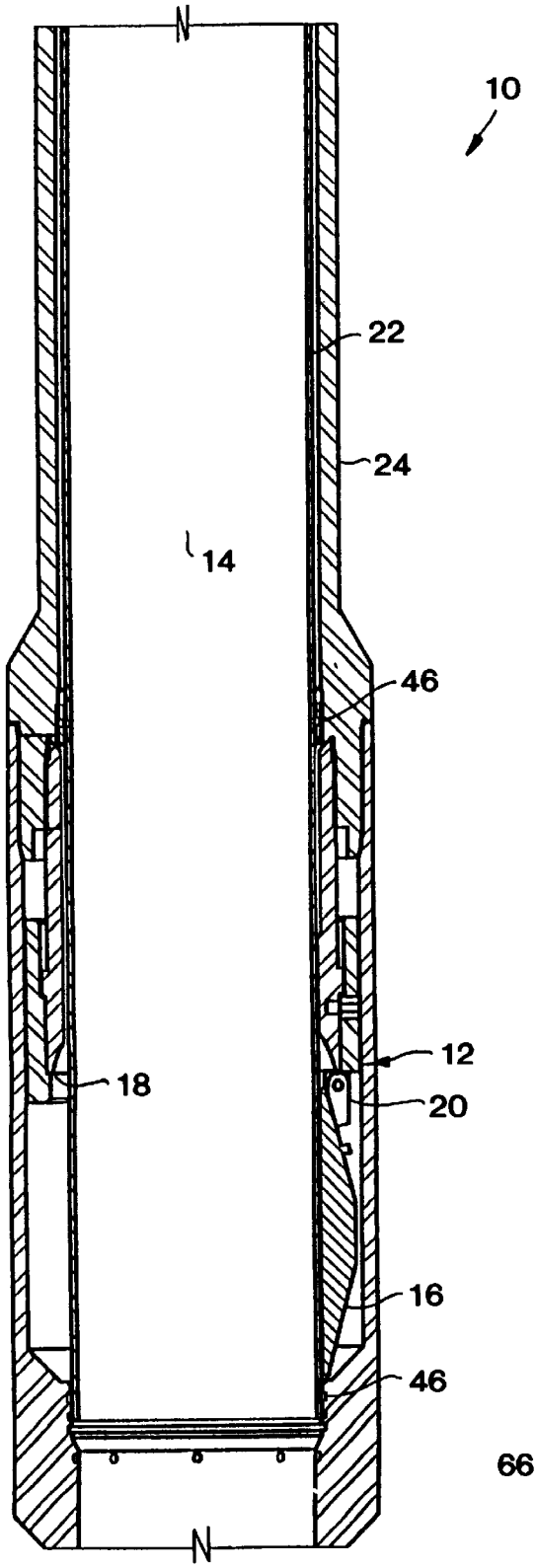
Figure 8E:
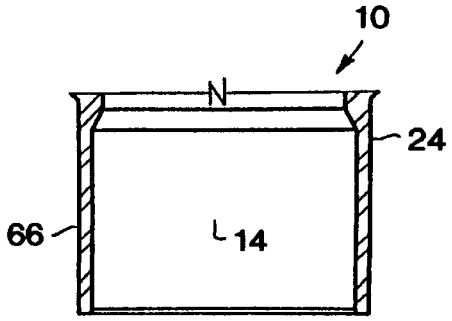

The shoulder 38 is radially expandable due to the colleted construction of the latch sleeve assembly 26 and its displacement in varying diameters of the housing assembly 24. For clarity of illustration, the colleted construction of the latch sleeve assembly 26 is not fully shown in FIGS. 1A–I, but is shown in FIGS. 5A&B, 6A&B, 7A&B and 8A&B. On the left-hand side of FIGS. 1B&C it may be seen that, with the valve 10 in its closed configuration, an outer radially enlarged portion 40 formed on the latch sleeve assembly 26 is received in a somewhat larger diameter bore 42 formed in the housing assembly 24, and the shoulder 38 is in a radially enlarged configuration in which the ring 34 is permitted to pass axially therethrough. On the right-hand side of FIGS. 1C&D, it may be seen that, with the valve 10 in its open configuration, the radially enlarged portion 40 is received in a radially reduced bore 44 formed in the housing assembly 24, and the shoulder 38 is radially retracted, the ring 34 thus being axially retained in a receptacle between the shoulders 36, 38.

The operator sleeve assembly 22 is initially restricted from displacing upwardly relative to the housing assembly 24 by engagement of the snap ring 28 in the recess 30 and by frictional forces resulting from wiper rings 46. The latch sleeve assembly 26 is releasably secured in its upwardly disposed position by engagement of a generally C-shaped snap ring 48 with an annular recess 50 formed externally on the latch sleeve assembly, and by the radially enlarged portion 40 engaging an internal shoulder 52 between the bores 42, 44. To downwardly displace the latch sleeve assembly 26 relative to the housing assembly 24, a downwardly biasing force is applied to the shoulder 36 by the ring 34, thereby disengaging the snap ring 48 from the recess 50 and forcing the radially enlarged portion 40 to radially retract into the bore 44. An external shoulder 54 formed on the operator sleeve assembly 22 contacts an internal shoulder 56 formed in the housing assembly 24 to prevent further downward displacement of the latch sleeve assembly 26 and the operator sleeve assembly.

The latch sleeve assembly 26 is retained in its downwardly disposed position by engagement of the snap ring 48 with a radially enlarged portion 58 formed externally on the latch sleeve assembly, the radially enlarged portion being disposed between the snap ring and the shoulder 52, as depicted on the right-hand side of FIG. 1C. Note that when the latch sleeve assembly 26 is displaced downwardly, the radially enlarged portion 58 passes through the snap ring 48, and the snap ring radially expands to permit the radially enlarged portion to pass therethrough. However, if the latch sleeve assembly 26 is then displaced upwardly relative to the housing assembly 24, the snap ring 48 will be carried upwardly with the radially enlarged portion 58 and into a radially reduced bore 60 formed in the housing assembly, and the snap ring will engage a shoulder 62 formed internally in the housing assembly, preventing further upward displacement of the snap ring.

Positioning of the snap ring 48 in the radially reduced bore 60 also prevents substantial radial expansion of the snap ring. Thus, after the snap ring 48 has engaged the shoulder 62, further upward displacement of the latch sleeve assembly 26 relative to the housing assembly 24 requires that a sufficient upwardly biasing force be applied to the latch sleeve assembly to cause the radially enlarged portion 58 to radially retract and pass axially through the snap ring. This upwardly biasing force is applied to the ring 34 by the aforementioned tool, such as a drill bit, the ring engaging the shoulder 38 to transfer the biasing force to the latch sleeve assembly 26.

When the latch sleeve assembly 26 is displaced upwardly, the radially enlarged portion 40 is eventually received within the radially enlarged bore 42 and the shoulder 38 radially expands to permit the ring 34 to pass upwardly therethrough. The ring 34 may then be retrieved with the tool.

The housing assembly 24 is configured for interconnection of the valve 10 in a tubular string, such as a string of casing or liner. For this purpose, the housing assembly 24 is provided with internally and externally threaded end connections 64, 66.

Figure 2:
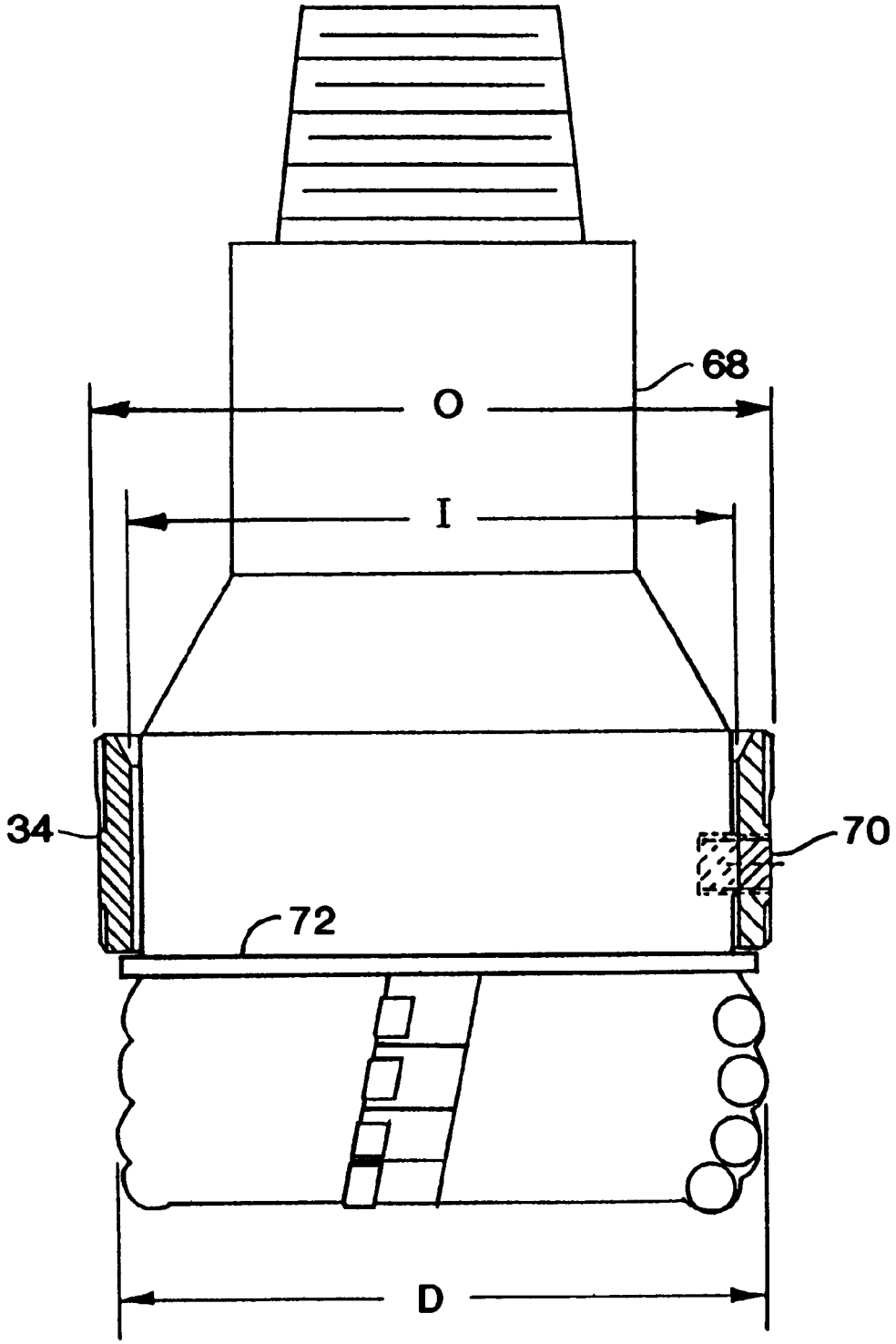
FIG. 2 is a partially cross-sectional and partially elevational view of a shifting ring releasably secured to a drill bit.

Referring additionally to FIG. 2, the ring 34 is representatively illustrated releasably secured to a drill bit 68. It is to be clearly understood that it is not necessary for the ring 34 or other shifting device to be attached to a drill bit or any other particular item of equipment in keeping with the principles of the present invention. However, such placement of the ring 34 provides convenient operation of the valve 10 during drilling operations. During other operations, such as completion operations, the ring 34 or other shifting device may be releasably secured to any other item of equipment.

The ring 34 is releasably secured to the drill bit 68 with three shear screws 70, only one of which is visible in FIG. 2. When the drill bit 68 is conveyed into the valve 10 at the lower end of a drill string, the ring 34 will engage the shoulder 36 as the drill bit passes through the valve. A downwardly biasing force is applied to the ring 34 by the drill bit and associated drill string to cause downward displacement of the latch sleeve assembly 26 as described above, thereby opening the valve 10 if it was previously closed. After the latch sleeve assembly 26 has been downwardly displaced, a somewhat greater downwardly biasing force is applied to the ring 34 by the drill bit 68 and associated drill string to shear the shear screws 70 and release the ring from the drill bit. The ring 34 is thus deposited in the latch sleeve assembly 26 in the receptacle between the shoulders 36, 38. It will be readily appreciated that, in this manner, downward conveyance of the drill bit 68 through the valve 10 automatically opens the valve if it was previously closed, without requiring any control over the valve from the earth's surface or other remote location.

Note that the drill bit 68 has an outer gauge diameter D corresponding to its maximum outer lateral dimension or twice its maximum radial dimension. In order for the ring 34 to engage the shoulders 36, 38 for operation of the valve 10, without the bit 68 also engaging the shoulders, the bit gauge diameter D is less than an outer diameter O of the ring 34. In a similar manner, in order for the ring 34 to be retrieved from the valve 10 when the bit 68 passes upwardly therethrough, an inner diameter I of the ring 34 is less than the bit gauge diameter D.

After the bit 68 has been conveyed downwardly through the valve 10, the ring 34 being deposited in the latch sleeve assembly 26, it may be necessary to retrieve the bit from the well, or at least raise the drill string so that the bit passes upwardly through the valve. When the bit 68 passes upwardly through the valve 10, the ring 34 engages a shoulder 72 formed externally on the bit. The bit 68 then applies an upwardly biasing force to the ring 34, which is transferred to the shoulder 38, radially retracting the radially enlarged portion 58, upwardly displacing the latch sleeve assembly 26 and closing the valve 10. It will thus be readily appreciated that the upward conveyance of the bit 68 through the valve 10 automatically closes the valve without requiring any control over the valve from the earth's surface or other remote location.

Figure 3:
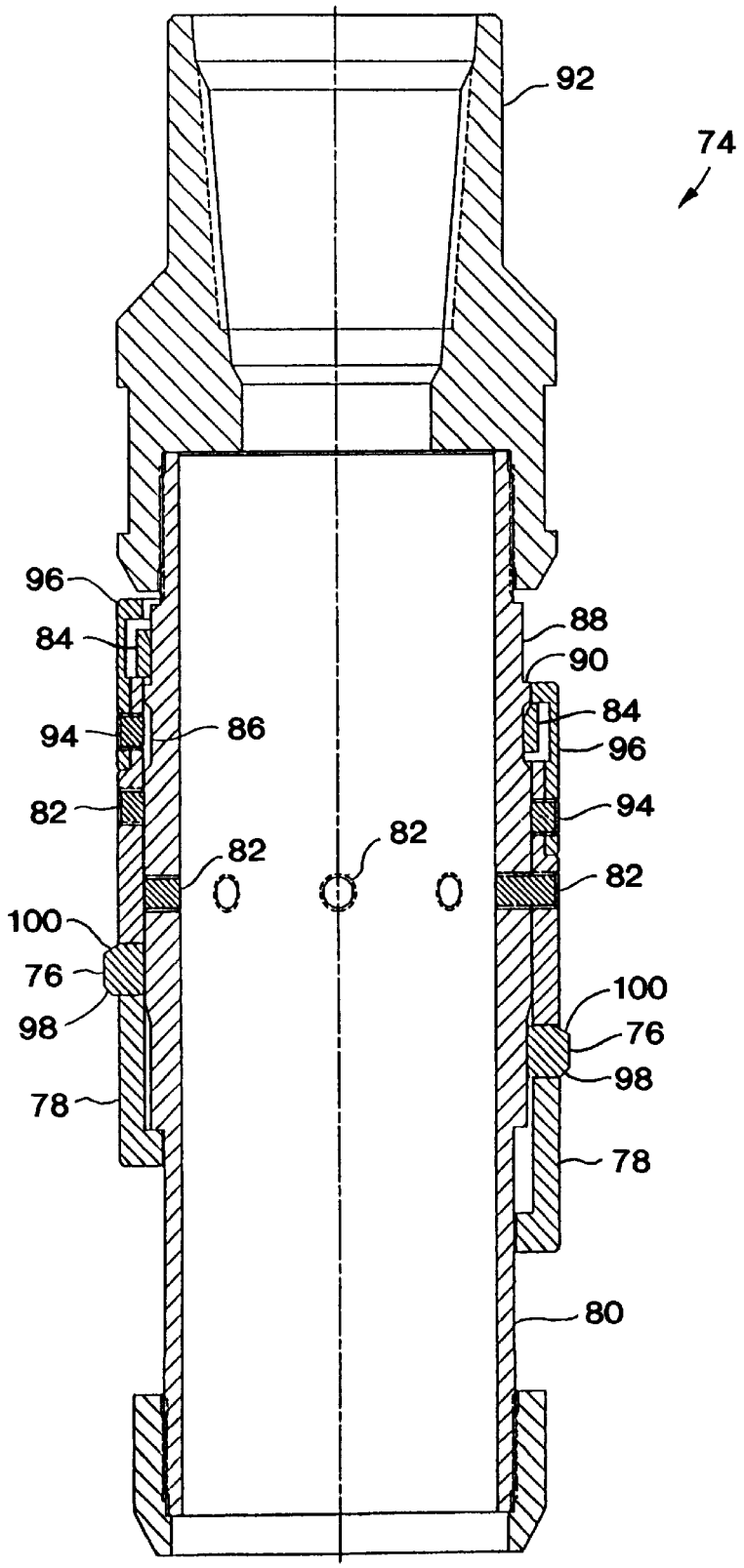
FIG. 3 is a cross-sectional view of a tool utilized to close the well control valve of FIGS. 1A–I, the tool being shown in shifted and unshifted configurations thereof.

Referring additionally now to FIG. 3, a tool 74 for closing the valve 10 is representatively illustrated. The right-hand side of FIG. 3 shows the tool 74 as it is initially conveyed into the valve 10, and the left-hand side of FIG. 3 shows the tool after it has been used to close the valve.

The tool 74 includes a series of circumferentially spaced apart lugs or dogs 76 extending radially outward through a corresponding series of openings formed through a sleeve 78 reciprocably disposed on a tubular inner mandrel 80. The sleeve 78 is releasably secured against displacement relative to the mandrel 80 when the tool is initially run into a well by a series of shear screws 82. On the left-hand side of FIG. 3 it may be seen that by shearing the shear screws 82, the sleeve 78 is permitted to displace upwardly relative to the mandrel 80.

Note that when the sleeve 78 displaces upwardly relative to the to mandrel 80, the dogs 76 are displaced radially outward due to an increase in the outer diameter of the mandrel underlying the dogs. Note, also, that if the sleeve 78 is displaced downwardly relative to the mandrel 80, the dogs 76 will be permitted to retract inwardly due to a decrease in the outer diameter of the mandrel. Such downward displacement of the sleeve 78 relative to the mandrel 80 is not normally encountered during use of the tool 74, but may aid in retrieving the tool should the dogs 76 become stuck in a restriction in a well.

A generally C-shaped snap ring 84 is initially disposed in an annular recess 86 formed externally on the mandrel 80. When the sleeve 78 is displaced upwardly relative to the mandrel 80, the snap ring 84 is forced to expand radially and displace upwardly with the sleeve until it is received in another annular recess or radially reduced portion 88 formed externally on the mandrel 80, the recess 88 having a shoulder 90 which prevents subsequent downward displacement of the snap ring relative to the mandrel.

If, after the sleeve 78 has been upwardly displaced relative to the mandrel 80 as shown on the left-hand side of FIG. 3, it is desired to downwardly displace the sleeve relative to the mandrel, for example, if the dogs 76 were to engage a restriction in a well while being retrieved, an upwardly biasing force may be applied to the tool 74 at its upper internally threaded connection 92, which would result in a corresponding downwardly biasing force being applied to the sleeve. This downwardly biasing force on the sleeve 78, if sufficiently great, will shear a series of shear screws 94 securing a snap ring retainer 96 to the sleeve. When the shear screws 94 have sheared, the sleeve 78 will then be permitted to displace downwardly relative to the mandrel 80, so that the dogs 76 may radially inwardly retract as described above.

The tool 74 may be conveyed into the valve 10 by a tubular string, such as segmented or coiled tubing, attached to the connection 92, or it may be conveyed by other means, such as wireline, slickline, etc. The tool 74 is utilized to close the valve 10 when the ring 34 is not present in the valve, although suitable modifications may be made to the tool to permit its use while the ring is present therein. For example, a lower shoulder 98 on each of the dogs 76 may be formed to accommodate the ring 34, and latch members may be provided on the tool 74 to engage and retrieve the ring when the valve is closed by the tool, so that the ring is retrieved along with the tool.

With the valve 10 open as shown on the right-hand side of FIGS. 1A–I and the ring 34 not present in the valve, the tool 74 is conveyed into the valve until the shoulders 98 on the dogs 76 contact the shoulder 36 in the latch sleeve assembly 26. If the latch sleeve assembly 26 has not already been downwardly displaced relative to the housing assembly 24 and engaged with the operator sleeve assembly 22 as described above, a downwardly biasing force may be applied to the tool 74 to downwardly displace the latch sleeve assembly as required, until the snap ring 28 engages the recess 32.

With the shoulders 98 engaged with the shoulder 36 and the latch sleeve assembly 26 latched to the operator sleeve assembly 22, a downwardly biasing force is applied to the tool 74 to shear the shear screws 82 as described above. At this point, the mandrel 80 and upper connection 92 will displace downwardly relative to the sleeve 78, dogs 76 and snap ring 84. The dogs 76 will extend radially outward and the snap ring 84 will be disposed in the recess 88 as shown on the left-hand side of FIG. 3.

Such radially outward extension of the dogs 76 positions the dogs so that upper shoulders 100 may engage the shoulder 38 of the latch sleeve assembly 26. Thus, when the tool 74 is initially conveyed into the valve 10, the dogs 76 are permitted to pass downwardly through the shoulder 38. However, when the dogs 76 have been radially extended by shearing the shear screws 82 and downwardly displacing the mandrel 80 relative to the sleeve 78, the dogs are not permitted to pass back upwardly through the shoulder 38.

After the dogs 76 have been radially outwardly extended as shown on the left-hand side of FIG. 3, an upwardly biasing force is applied to the tool 74 to bring the dogs into contact with the shoulder 38. This upwardly biasing force displaces the latch sleeve assembly 26 and operator sleeve assembly 22 upwardly relative to the housing assembly 24 along with the tool 74. The valve 10 opens when the operator sleeve assembly 22 has been upwardly displaced sufficiently far so that the flapper 16 is permitted to sealingly engage the seat 18.

Figure 1B:
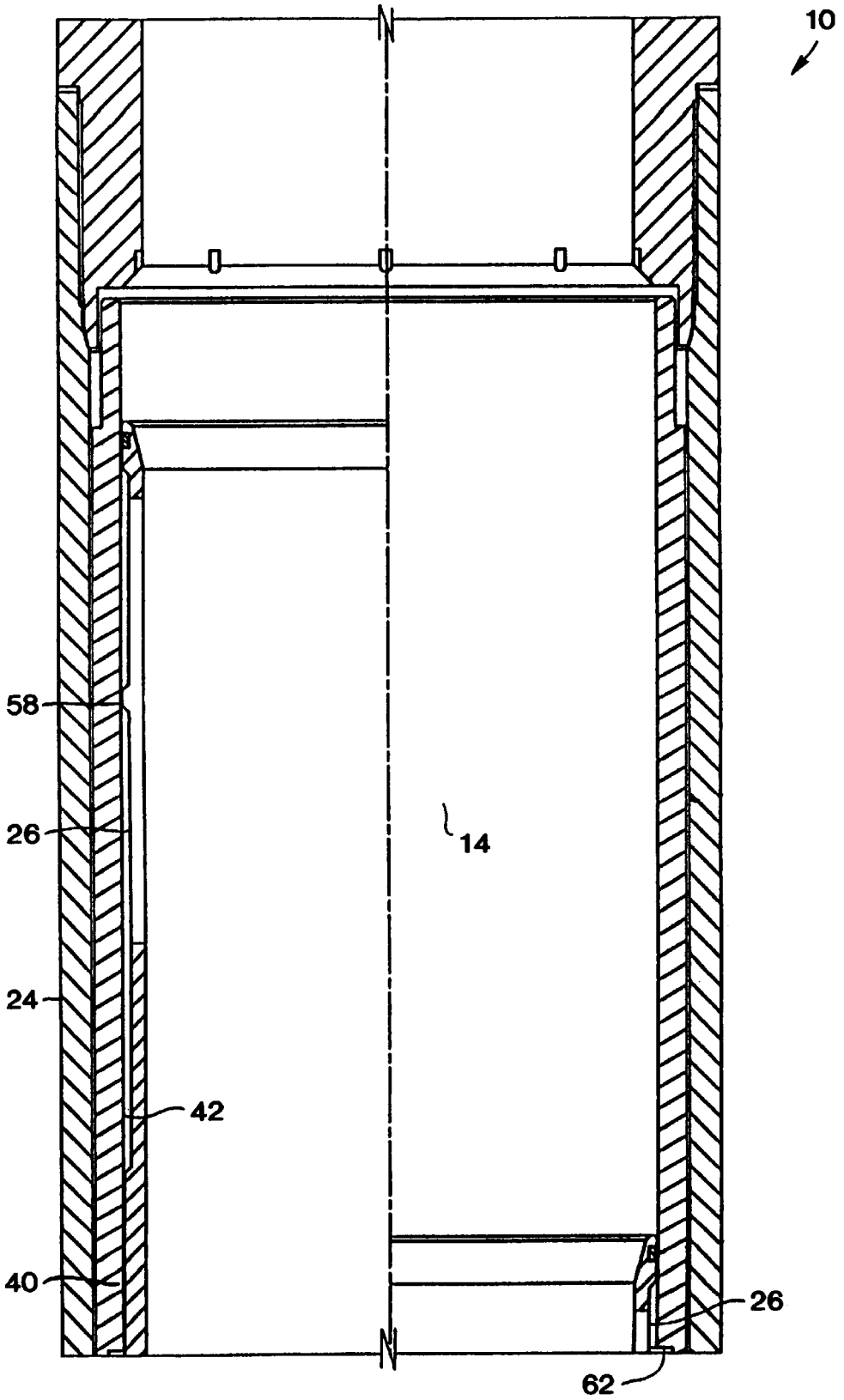
Figure 1C:
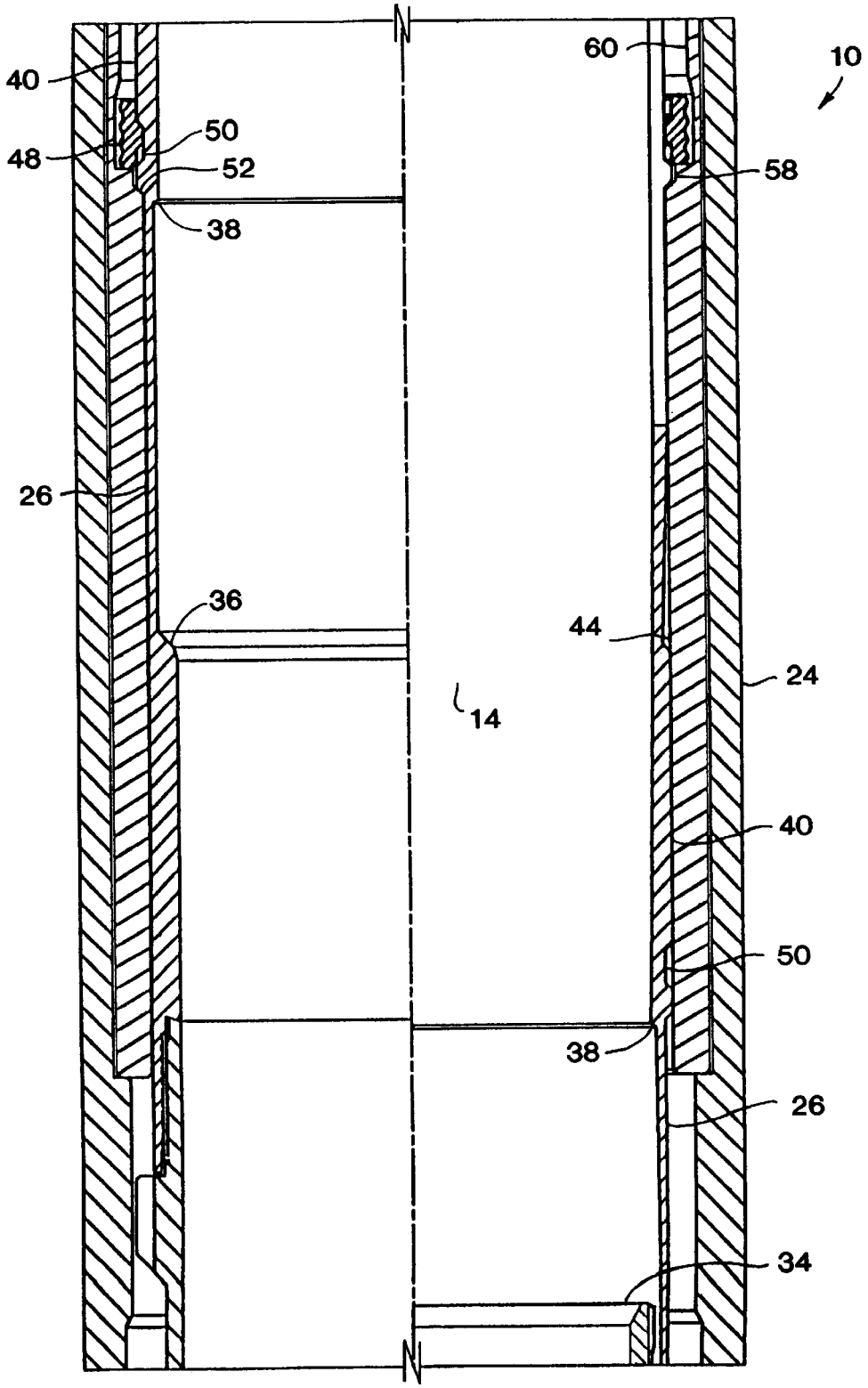
Figure 1D:
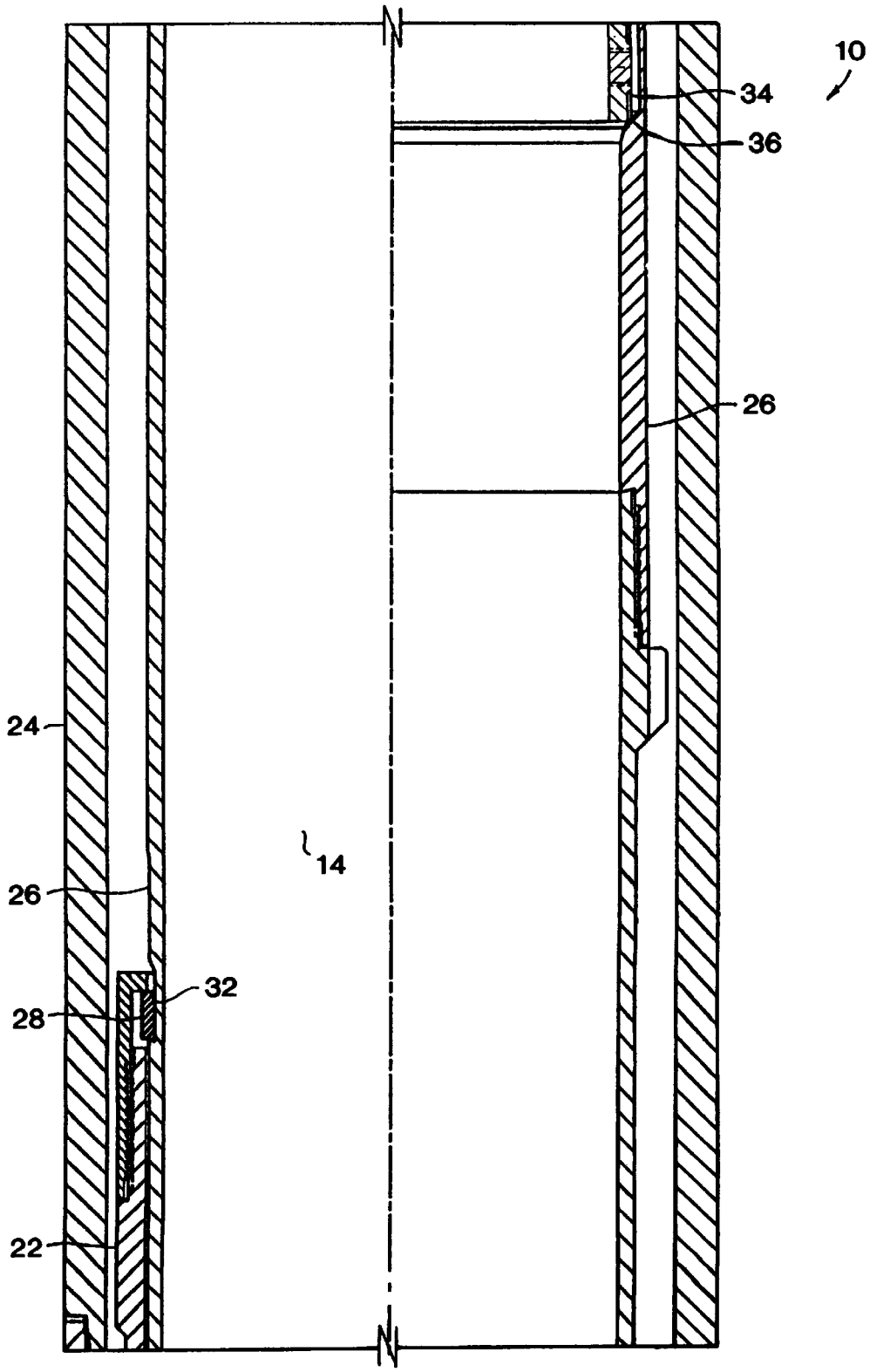
Figure 1E:
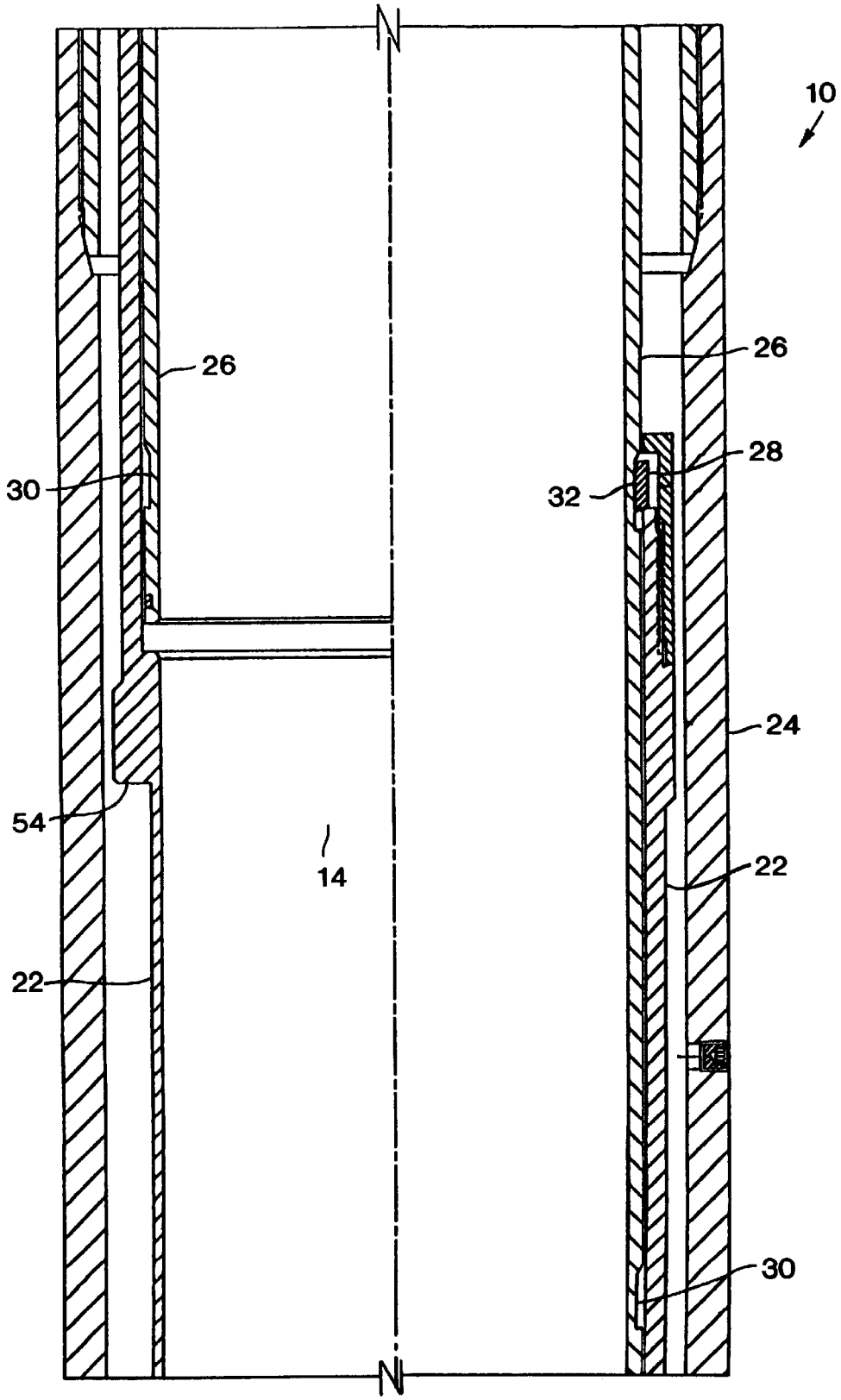
Figure 1F:
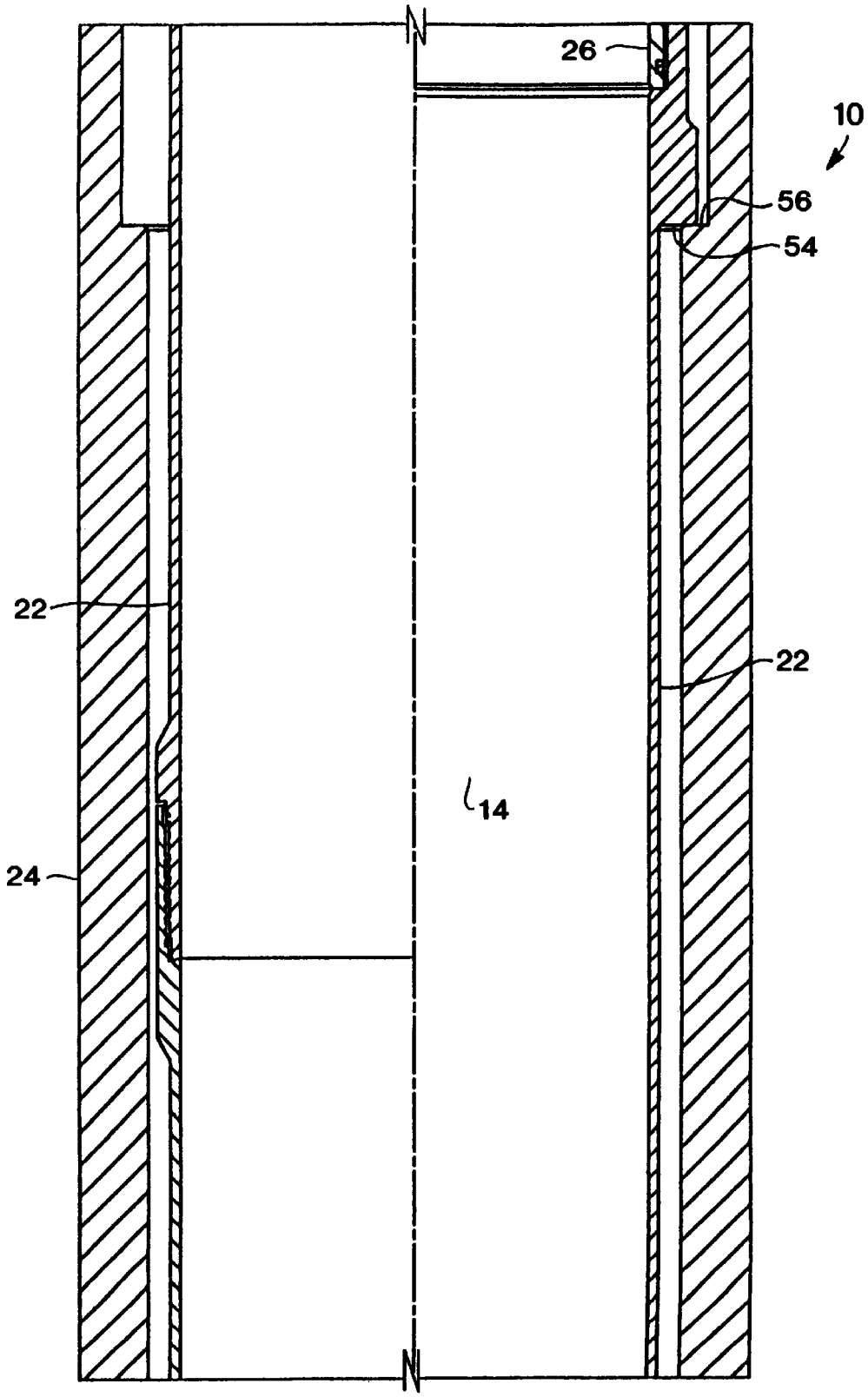
Figure 1G:
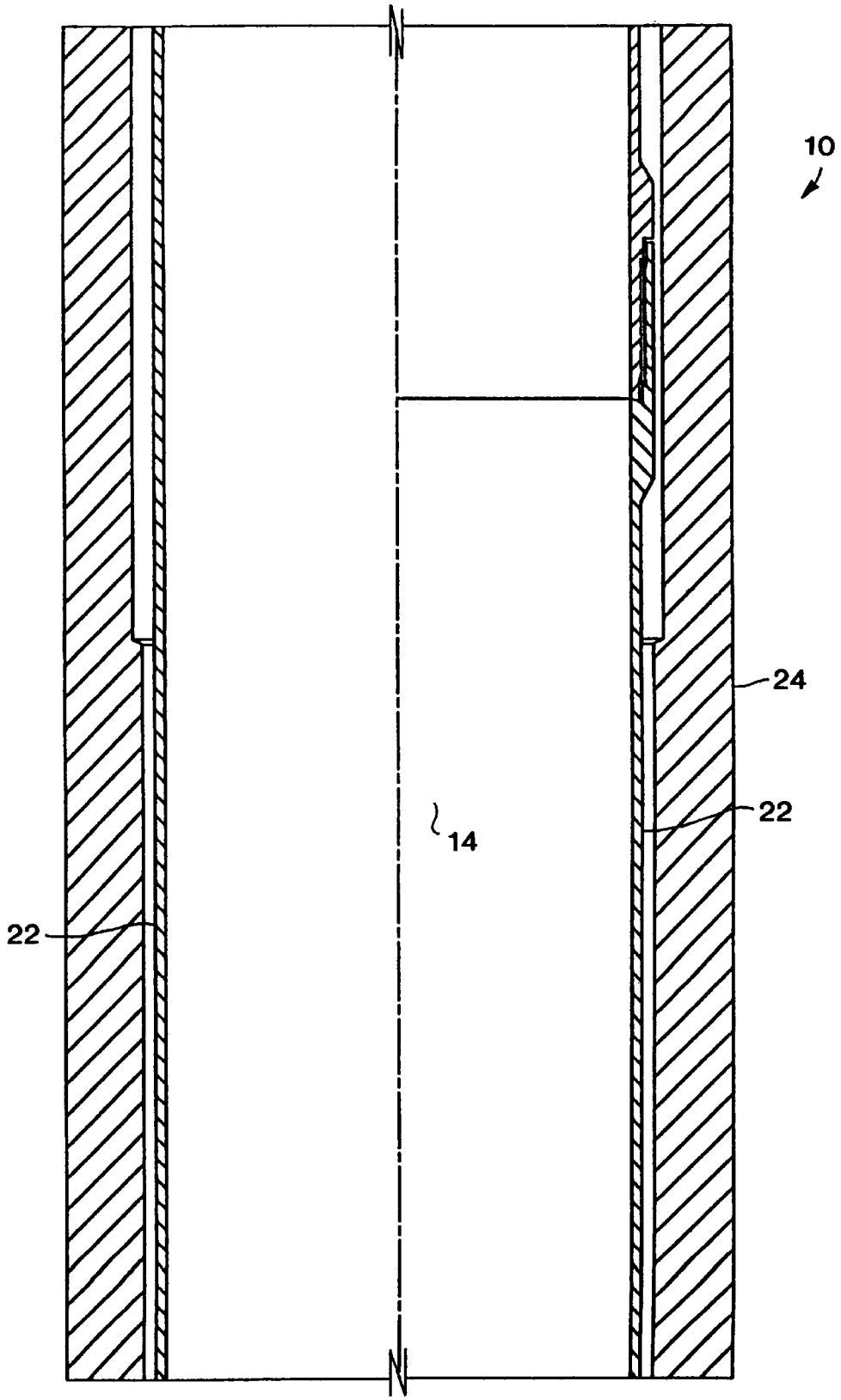
Figure 1H:
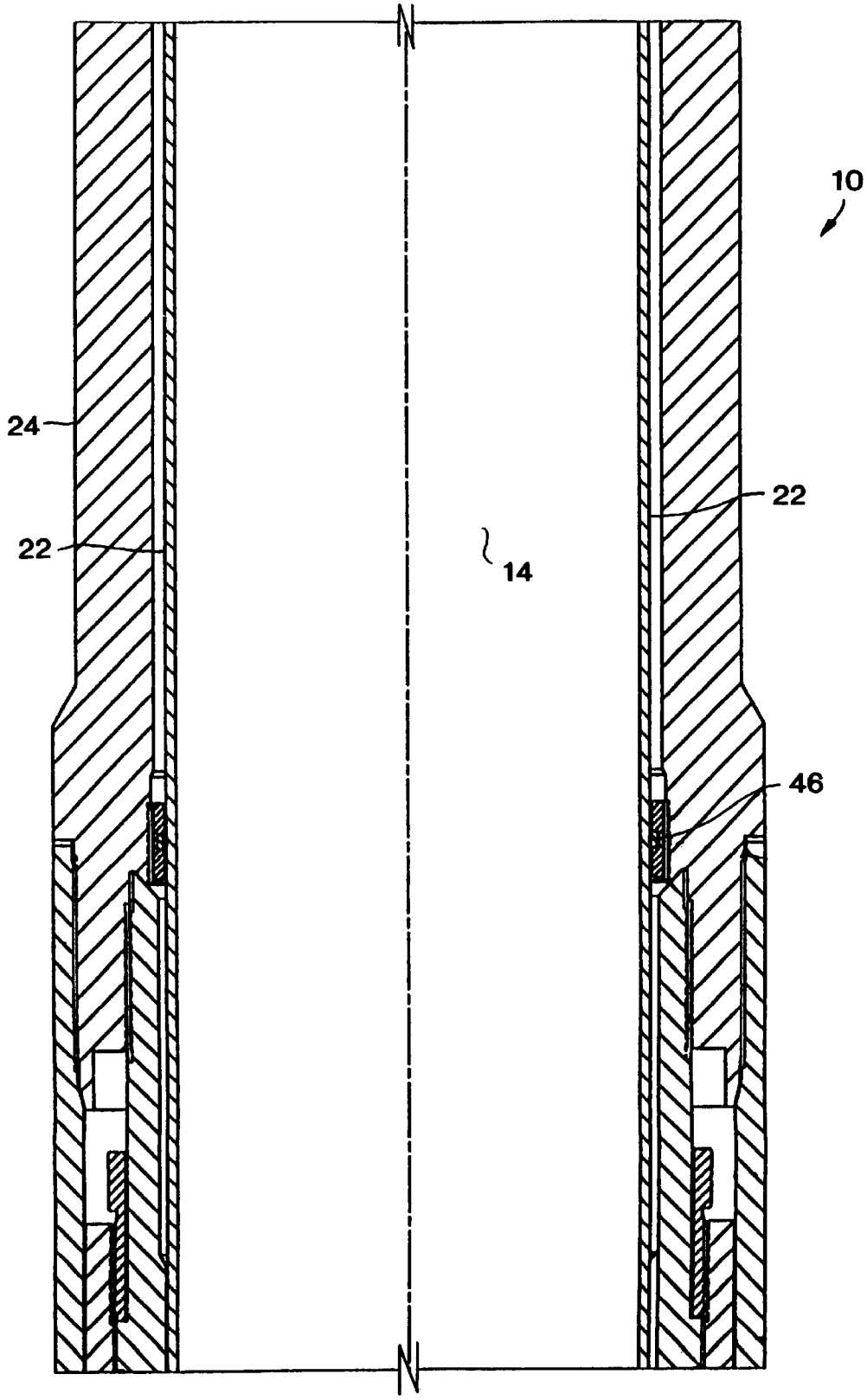
Figure 1I:
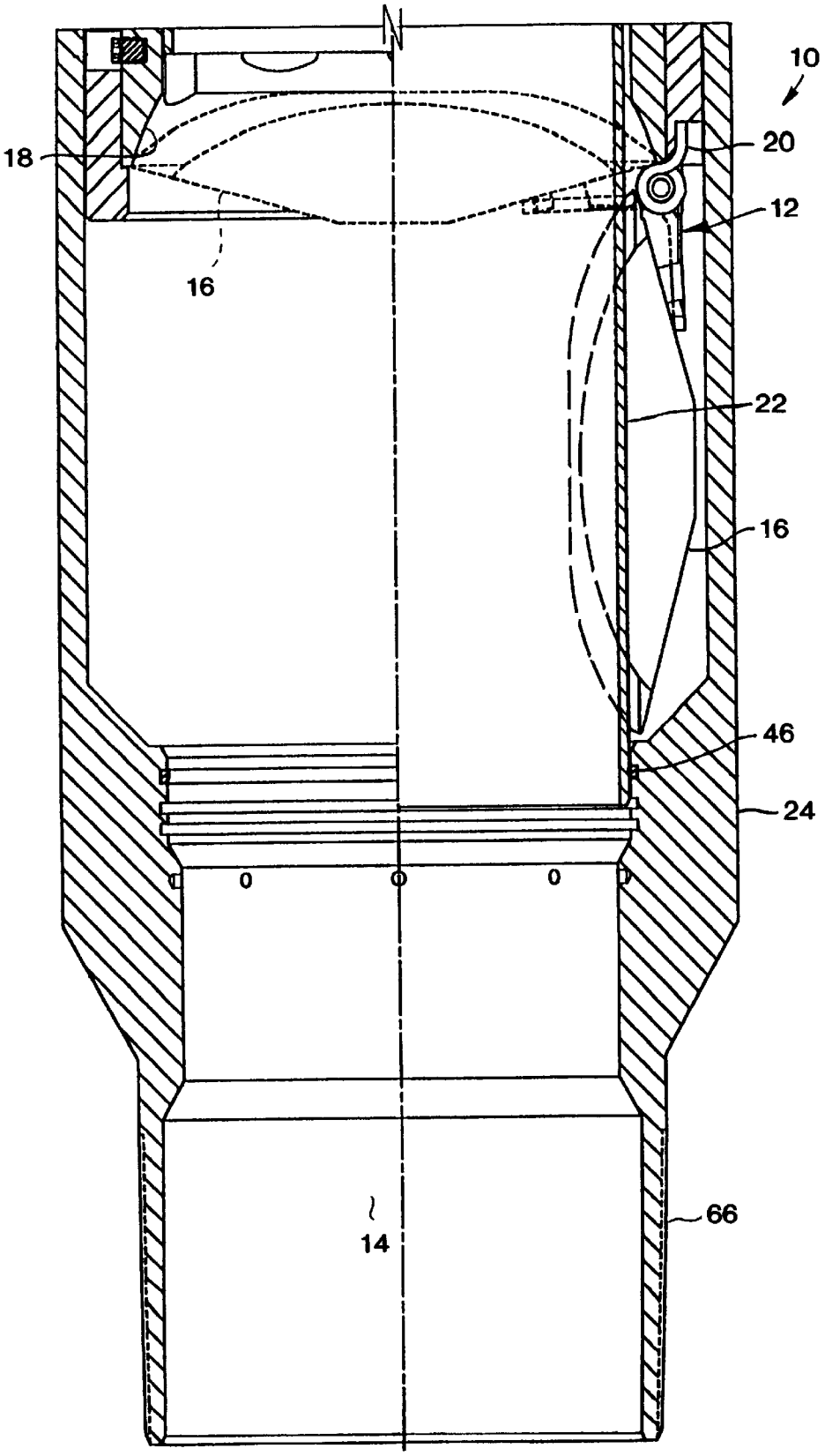

Note that the shoulder 38 expands when the radially enlarged portion 40 of the latch sleeve assembly 26 is positioned in the bore 42 as shown on the left-hand side of FIGS. 1B&C. Thus, the shoulders 100 on the dogs 76 may be released from their engagement with the shoulder 38 when the shoulder 38 radially expands, the tool 74 being then permitted to pass upwardly through the shoulder 38. Alternatively, the shoulders 100 may remain engaged with the shoulder 38 when the portion 40 is positioned in the bore 42 and the shoulder 38 is radially enlarged, and an further upwardly biasing force may be applied to the tool 74 to shear the shear screws 94 and permit the dogs 76 to radially inwardly retract as described above.

Therefore, when the tool 74 is initially conveyed into the valve 10 and the latch sleeve assembly 26 is in its downwardly disposed position as shown on the right-hand side of FIGS. 1A–I, the dogs 76 are permitted to pass downwardly through the shoulder 38 and engage the shoulder 36. When a downwardly biasing force is applied to the tool 74 to shear the shear screws 82, the dogs 76 are radially outwardly extended, so that they are no longer permitted to pass upwardly through the shoulder 38. An upwardly biasing force is then applied to the tool 74 to shift the latch sleeve assembly 26 upwardly, whereupon the valve 10 closes and the shoulder 38 radially expands. The dogs 76 may then pass upwardly through the shoulder 38, or a further upwardly biasing force may be applied to the tool 74 to shear the shear screws 94 and radially retract the dogs so that they will be permitted to pass upwardly through the shoulder 38.

Figure 4:
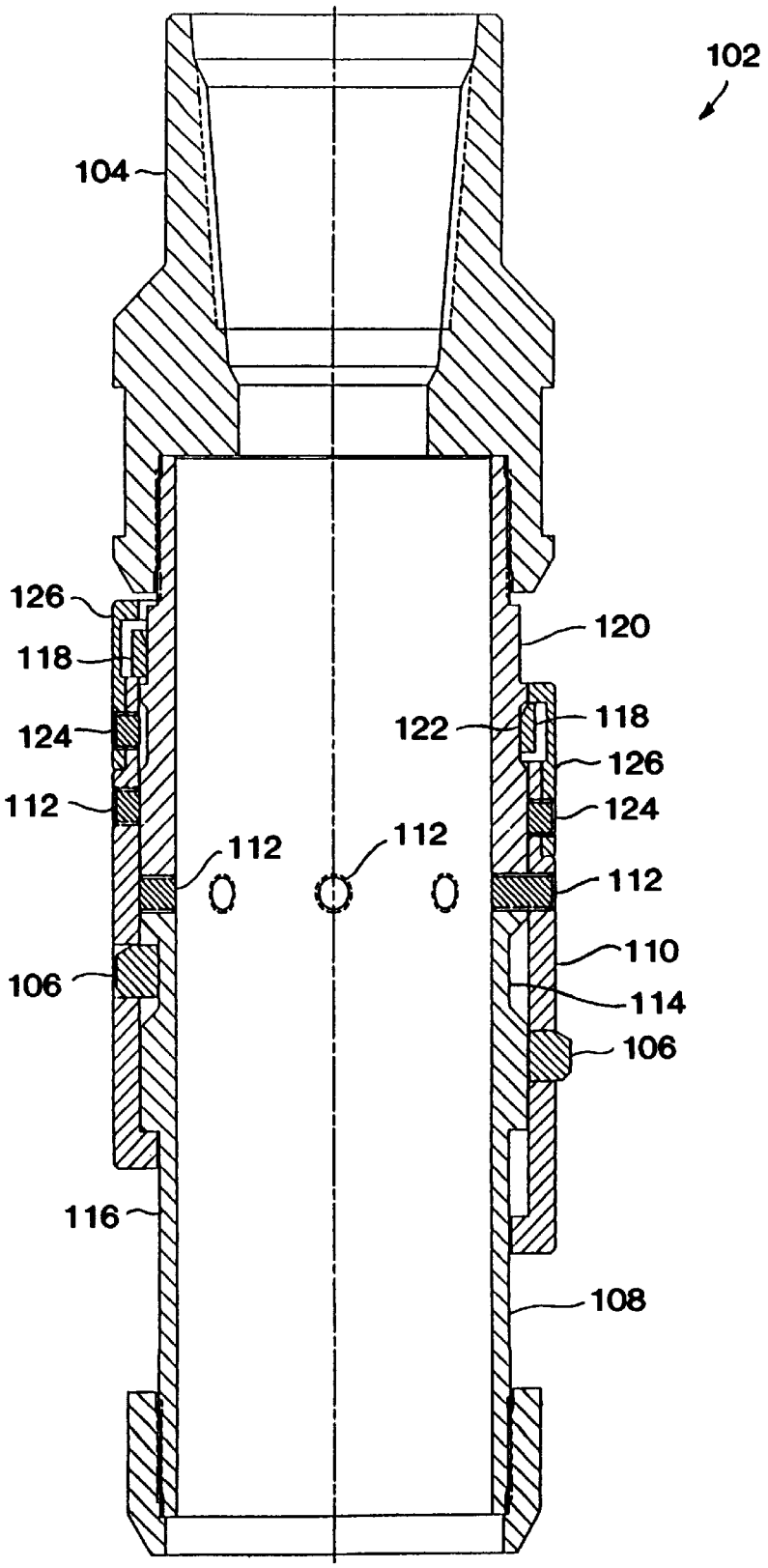
FIG. 4 is a cross-sectional view of a tool utilized to open the well control valve of FIGS. 1A–I, the tool being shown in shifted and unshifted configurations thereof.

Referring additionally now to FIG. 4, a tool 102 for opening the valve 10 is representatively illustrated. The tool 102 may be utilized to displace the latch sleeve assembly 26 downwardly into operative engagement with the operator sleeve assembly 22 as shown on the right hand side of FIGS. 1A–I, or to open the valve 10 if the snap ring 28 is already received in the recess 32.

With the valve 10 in its closed configuration as shown on the left-hand side of FIGS. 1A–I, the tool 102 is conveyed into the valve, for example, by a tubular string, such as segmented or coiled tubing, attached to an upper internally threaded connector 104 of the tool. The tool 102 may also be conveyed by other means, such as wireline, slickline, etc.

When initially conveyed into the valve 10, a series of circumferentially spaced apart lugs or dogs 106 are radially outwardly extended as shown on the right-hand side of FIG. 4. The dogs 106 are maintained in their radially outwardly extended positions by a generally tubular inner mandrel 108. The dogs 106 extend through openings formed through a sleeve 110 reciprocably disposed on the mandrel 108. The sleeve 110 is releasably secured against displacement relative to the mandrel 108 by a series of shear screws 112.

The dogs 106 engage the shoulder 36 in the latch sleeve assembly 26 as the tool 102 passes downwardly through the valve 10. A downwardly biasing force is then applied to the tool 102, thereby displacing the latch sleeve assembly and operator sleeve assembly 22 downward to the open configuration as shown on the right-hand side of FIGS. 1A–I. A further downwardly biasing force may then be applied to the tool 102 to shear the shear screws 112 and permit the mandrel 108 to displace downwardly relative to the sleeve 110 and dogs 106.

When the mandrel 108 displaces downwardly relative to the sleeve 110, the dogs 106 are permitted to radially inwardly retract into an annular recess 114 formed externally on the mandrel 108. Such radial retraction of the dogs 106 permits the dogs to pass upwardly through the radially inwardly retracted shoulder 38. The tool 102 may then be retrieved upwardly through the valve 10.

Note that, before the sleeve 110 has been upwardly displaced relative to the mandrel 108, the dogs 106 may be inwardly retracted by applying an upwardly biasing force to the tool, for example, if the dogs were to become stuck in a restriction in a well while the tool 102 is being raised therein. This upwardly biasing force will shear the shear screws 112 and permit the sleeve 110 to displace downwardly relative to the mandrel 108, the dogs then overlying a radially reduced portion 116 of the mandrel and being permitted to retract radially inward.

When the sleeve 110 has been upwardly displaced relative to the mandrel 108 as shown on the left-hand side of FIG. 4 after opening the valve 10, the sleeve is prevented from subsequently displacing downward relative to the mandrel by engagement of a snap ring 118 in an annular recess or radially reduced portion 120 formed externally on the mandrel 108. The snap ring 118 is initially received in an annular recess 122 formed externally on the mandrel 108 as shown on the right-hand side of FIG. 4, but is displaced upward into engagement with the recess 120 when the sleeve 110 displaces upwardly relative to the mandrel 108. Since the dogs 106 are radially retracted after the tool 102 has been used to open the valve 10 as described above, it should not be necessary to further displace the sleeve 110. However, if it is desired to displace the sleeve 110 after it has displaced upwardly sufficiently far to engage the snap ring 118 in the recess 120, a series of shear screws 124 securing a snap ring retainer 126 relative to the sleeve may be sheared, thereby permitting the sleeve to displace downwardly relative to the mandrel 108.

Referring additionally now to FIGS. 5A–E, 6A–E, 7A–E and 8A–E, the valve 10 is representatively illustrated at a somewhat reduced scale in a sequence of configurations as it is operated within a well. FIGS. 5A–E show the valve 10 as it is initially run into a well. FIGS. 6A–E show the valve 10 after the latch sleeve assembly 26 has been downwardly displaced into operative engagement with the operator sleeve assembly 22. FIGS. 7A–E show the valve 10 after it has been closed by upwardly displacing the latch sleeve assembly 26 and operator sleeve assembly 22. FIGS. 8A–E show the valve after it has been opened by downwardly displacing the latch sleeve assembly 26 and operator sleeve assembly 22.

In FIGS. 5A–E it may be seen that the latch sleeve assembly 26 is in its upwardly disposed position and the operator sleeve assembly 22 is in its downwardly disposed position, the snap ring 28 being engaged in the lower recess 30 on the latch sleeve assembly. The operator sleeve assembly 22 maintains the closure assembly 12 in its open configuration permitting fluid flow through the flow passage 14. The shoulder 38 is in its radially expanded configuration, the radially enlarged portion 40 being received in the bore 42.

In FIGS. 6A–E it may be seen that the latch sleeve assembly 26 has been downwardly displaced, so that the snap ring 28 now engages the upper recess 32 on the latch sleeve assembly, and the latch sleeve assembly is now operatively engaged with the operator sleeve assembly 22. The radially enlarged portion 40 is now received in the bore 44 and the shoulder 38 is in its radially retracted configuration. The closure assembly 12 remains open to fluid flow therethrough.

The latch sleeve assembly 26 may be downwardly displaced to the position shown in FIGS. 6A–E by the ring 34 carried on the bit 68 or other item of equipment (see FIG. 2), in which case the ring 34 could be deposited in the valve 10 as shown in FIG. 1C&D, or the latch sleeve assembly could be downwardly displaced utilizing the opening tool 102 (see FIG. 4).

In FIGS. 7A–E it may be seen that the latch sleeve assembly 26 and operator sleeve assembly 22 have been upwardly displaced from their positions shown in FIGS. 6A–E, thereby closing the closure assembly 12 and preventing fluid flow through the flow passage 14. The shoulder 38 is now in its radially expanded configuration, the radially enlarged portion 40 now being received in the bore 42.

The latch sleeve assembly 26 and operator sleeve assembly 22 may be upwardly displaced to the position shown in FIGS. 7A–E by the ring 34 retrieved on the bit 68 or other item of equipment (see FIG. 2), in which case the ring 34 is retrieved from the valve 10 when the bit is passed upwardly through the latch sleeve assembly, the ring engaging the shoulders 38 and 72 to cause upward displacement of the latch sleeve assembly. Alternatively, the latch sleeve assembly and operator sleeve assembly could be upwardly displaced utilizing the closing tool 74 (see FIG. 3).

In FIGS. 8A–E, it may be seen that the latch sleeve assembly 26 and operator sleeve assembly 22 have been downwardly displaced from their position as shown in FIGS. 7A–E, the operator sleeve assembly now maintaining the closure assembly 12 in its open configuration, so that fluid flow is again permitted therethrough. The radially enlarged portion 40 is now received in the bore 44 and the shoulder 38 is in its radially retracted configuration. The latch sleeve assembly 26 and operator sleeve assembly 22 may be downwardly displaced to the position shown in FIGS. 8A–E by the ring 34 carried on the bit 68 or other item of equipment (see FIG. 2), in which case the ring 34 could be deposited in the valve 10 as shown in FIGS. 1C&D, or the latch sleeve assembly could be downwardly displaced utilizing the opening tool 102 (see FIG. 4).

It will be readily appreciated that the valve 10 as shown in FIGS. 8A–E is similar to the valve as shown in FIGS. 6A–E, in each case the valve being in an open configuration thereof. However, the valve 10 is operated from the open configuration shown in FIGS. 5A–E to the open configuration shown in FIGS. 6A–E by displacing the latch sleeve assembly 26 downward to operatively engage the operator sleeve assembly 22, but the valve is operated from the closed configuration shown in FIGS. 7A–E to the open configuration shown in FIGS. 8A–E by displacing both the latch sleeve assembly and the operator sleeve assembly downward. It will also be readily appreciated that the valve 10 may be cycled repeatedly between its closed and open configurations as shown in FIGS. 7A–E and FIGS. 8A–E by repeatedly conveying the bit 68 and ring 34 downwardly into the valve and then retrieving the bit and the ring as described above. Thus, the closure assembly 12 is automatically opened when the bit 68 is conveyed downwardly through the valve 10, and is automatically closed when the bit is retrieved upwardly through the valve. Of course, the valve 10 may also be cycled between its closed and open configurations utilizing the closing tool 74 and opening tool 102 as described above.

Referring additionally now to FIGS. 9A–F a packer setting tool 130 embodying principles of the present invention is representatively illustrated. The setting tool 130 is useful in methods of completing a well in an underbalanced condition described below. Specifically, the setting tool 130 includes an isolation valve 132, which prevents fluid pressure in an inner axial flow passage 134 formed through the setting tool from prematurely causing setting of a packer; a circulation valve 136, which permits circulation of fluid between the flow passage 134 and the exterior of the setting tool; a setting sleeve retainer mechanism 138, which prevents premature setting of the packer due to mechanical loads; and various other advantageous features described more fully below. Of course, a packer setting tool incorporating principles of the present invention may also be utilized in methods other than underbalanced drilling and completions of wells.

The isolation valve 132 includes an inner isolation sleeve 140 reciprocably disposed in the flow passage 134. The isolation sleeve 140 carries seals 142 externally thereon which straddle a series of circumferentially spaced apart ports 144 (only one of which is visible in FIG. 9A) formed through a sidewall of a generally tubular mandrel assembly 146. The isolation sleeve 140 is releasably secured in this position preventing fluid flow through the ports 144 by one or more shear pins 148 installed through a ring 150 and into the isolation sleeve. However, when a ball 152 or other plugging device is sealingly engaged with the isolation sleeve 140 and a sufficient fluid pressure differential is applied from above to below the ball, the shear pins 148 will shear and the isolation sleeve will displace downwardly, thereby uncovering the ports 144 and permitting fluid flow therethrough.

Figure 9A:
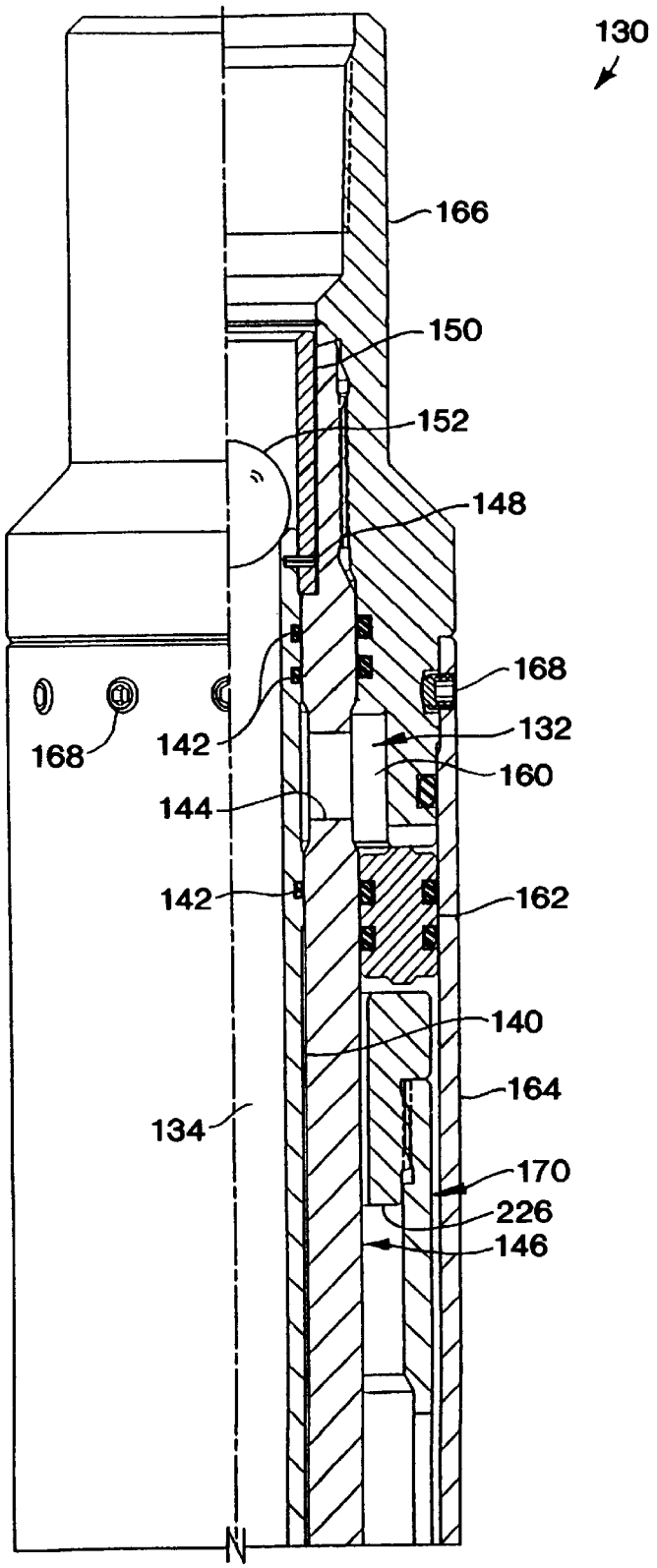
FIGS. 9A–F are quarter-sectional views of successive axial portions of a packer setting tool embodying principles of the present invention.
Figure 9B:
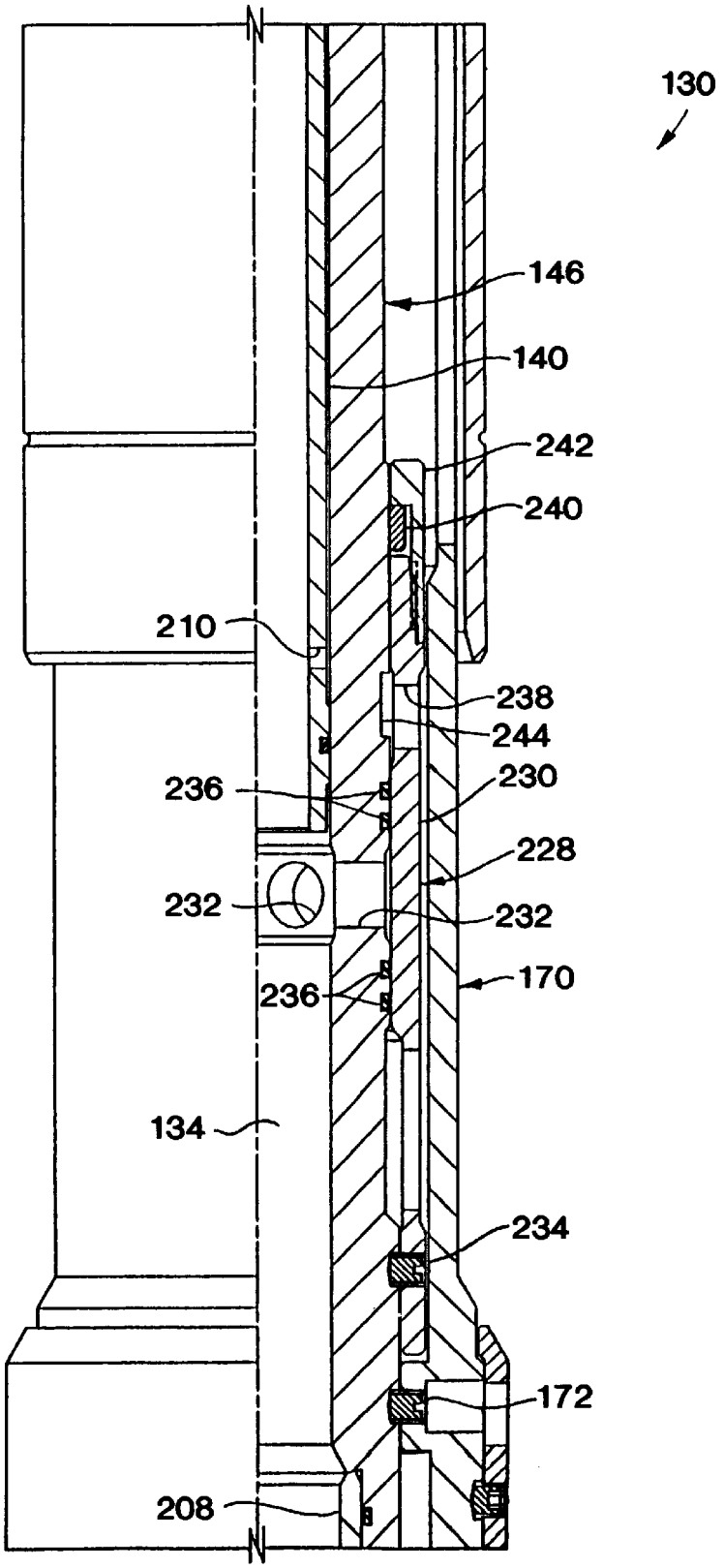
Figure 9C:
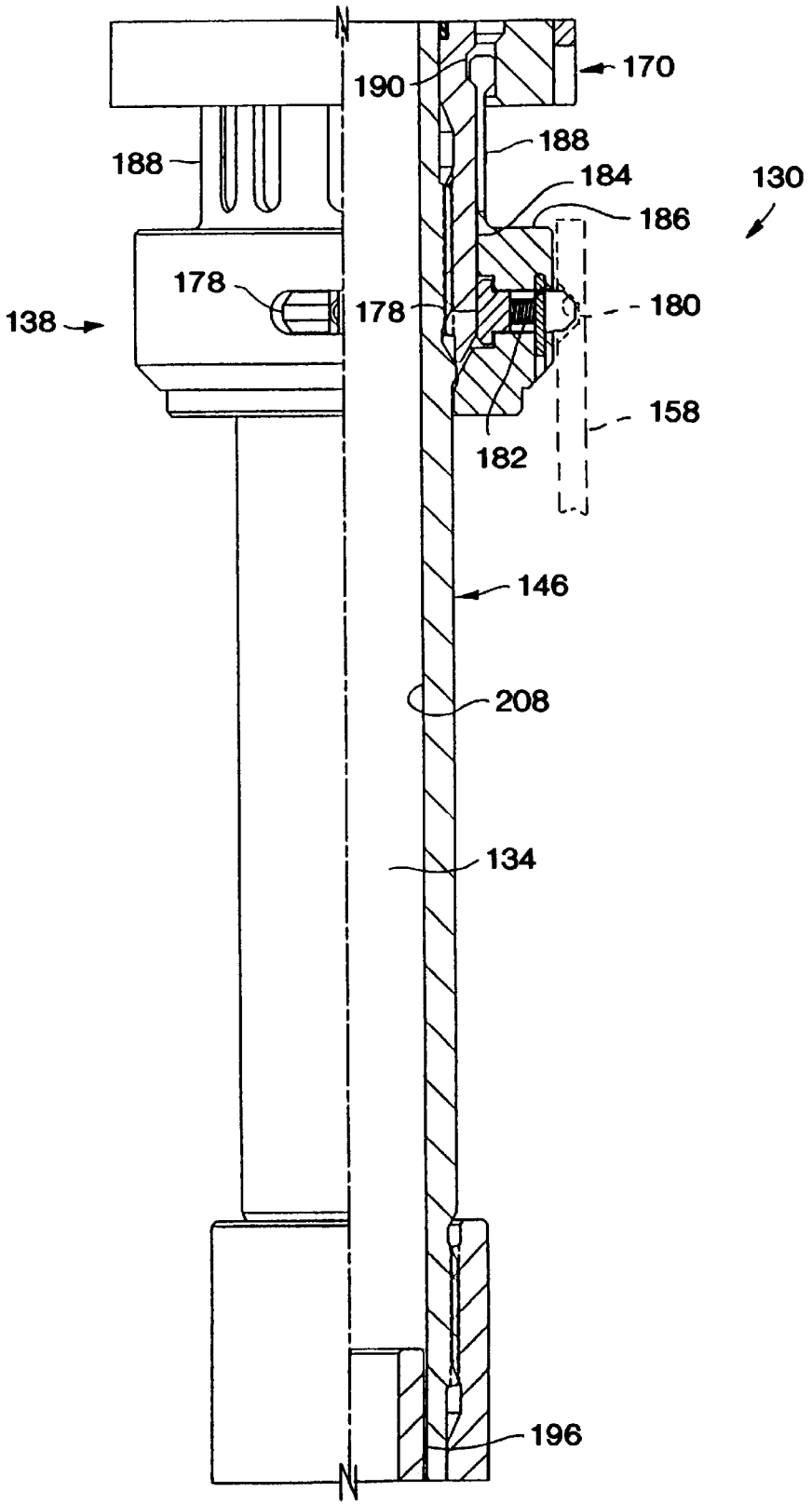
Figure 9D:
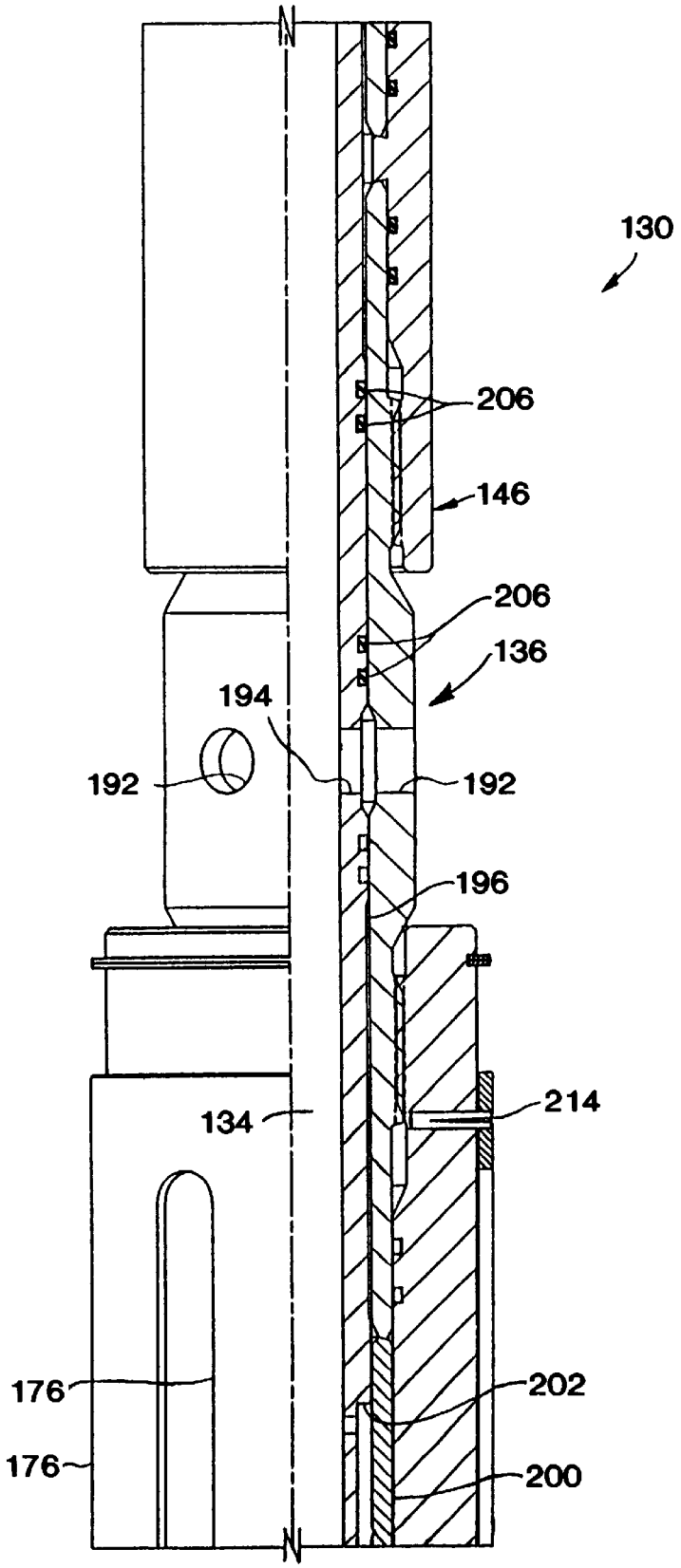
Figure 9E:
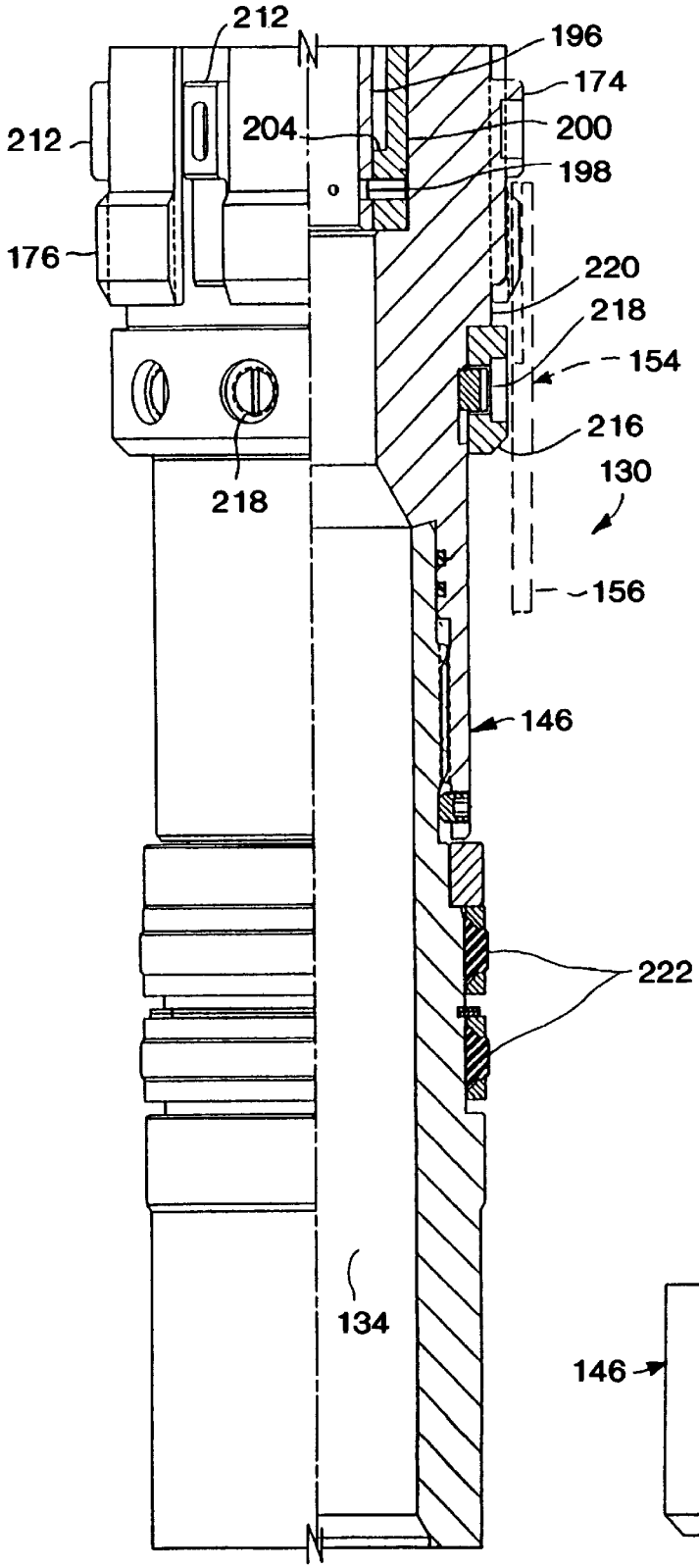
Figure 9F:
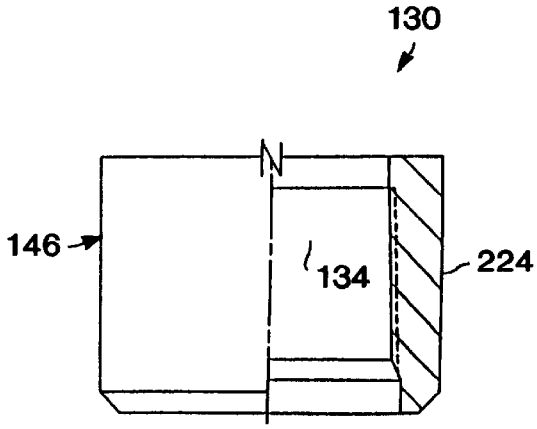

A packer 154 is represented in FIG. 9E using dashed lines. Specifically, an upper portion of the packer 154 is shown representing a mandrel 156 or upper scoophead portion of the packer. The setting tool 130 as depicted in FIGS. 9A–F is configured for use with a Model TWR packer available from Halliburton Energy Services, Inc. of Duncan, Okla., but it is to be clearly understood that the packer 154 may be another type of packer, and the setting tool may be appropriately configured for use with other packers, without departing from the principles of the present invention.

It is well known to those skilled in the art that the Model TWR packer, and many other packers, is set by displacing the mandrel 156 relative to an outer slip and seal element assembly (not shown in FIGS. 9A–F) of the packer 154. Typically, a setting sleeve 158 (shown in FIG. 9C in dashed lines) is utilized to apply a biasing force to the outer slip and seal element assembly while an oppositely directed biasing force is applied to the mandrel 156 to set the packer 154. Thus, to set the packer 154, an upwardly biasing force is applied to the mandrel 156 while a downwardly biasing force is applied to the setting sleeve 158.

When the isolation sleeve 140 is displaced downwardly as described above, fluid pressure in the flow passage 134 is permitted to enter an annular chamber 160 and apply a downwardly biasing force to an annular piston 162 sealingly and reciprocably disposed between the mandrel assembly 146 and an outer sleeve 164. The sleeve 164 is secured to an upper internally threaded connector 166 by means of a series of set screws 168 installed through the sleeve and into the upper connector. The upper connector 166 is threadedly and sealingly attached to the mandrel assembly 146 and permits attachment of the setting tool 130 to a tubular string, such as a work string of segmented tubing.

To set the packer 154, the piston 162 is biased downwardly into contact with a force transmitting structure or sleeve assembly 170, which is reciprocably disposed on the mandrel assembly 146. The sleeve assembly 170 is releasably secured against displacement relative to the mandrel assembly 146 by one or more shear screws 172 installed through the sleeve assembly and into the mandrel assembly 146. The piston 162 is exposed to fluid pressure in the chamber 160 and to fluid pressure external to the setting tool 130. When fluid pressure in the chamber 160 is sufficiently greater than fluid pressure external to the setting tool 130, the piston 162 biases the sleeve assembly 170 downwardly with enough force to shear the shear pins 172 and downwardly displace the sleeve assembly relative to the mandrel assembly 146.

When the sleeve assembly 170 displaces downward sufficiently far, it contacts the packer setting sleeve 158 and applies a downwardly biasing force to the setting sleeve, displacing the setting sleeve downward relative to the mandrel assembly 146. The setting sleeve 158 is initially secured against displacement relative to the mandrel assembly 146 by a series of lugs or dogs 178 extending radially outward into engagement with an annular recess 180 formed internally in the setting sleeve. Each of the lugs 178 is biased radially inward by a spring 182, but the lugs are maintained in their radially outwardly extended positions by an outer diameter 184 formed on the mandrel assembly 146.

The lugs 178 extend outward through openings formed through a member 186 having upwardly extending collets 188 formed thereon. The collets 188 are initially received in a radially reduced annular recess 190 formed externally on the mandrel assembly 146. The collets 188 are prevented from displacing relative to the recess 190 by the sleeve assembly 170, which outwardly overlies the collets and prevents their radial expansion out of the recess. Thus, the setting sleeve 158 is secured relative to the member 186 by the lugs 178, and the member 186 is secured relative to the mandrel assembly 146 by the collets 188, and therefore, the setting sleeve is prevented from displacing relative to the mandrel assembly.

However, when the sleeve assembly 170 is downwardly displaced relative to the mandrel assembly 146 as described above, the sleeve assembly no longer retains the collets 188 in the recess 190, and the setting sleeve 158 is then permitted to displace relative to the mandrel assembly 146. Downward displacement of the sleeve assembly 170 relative to the mandrel assembly 146 eventually brings the sleeve assembly into contact with the setting sleeve 158. Thus, the sleeve assembly 170 is permitted to apply a downwardly biasing force to the setting sleeve 158. This downwardly biasing force is the same as that applied to the sleeve assembly 170 by the piston 162 and is due to the pressure differential between the chamber 160 (or the flow passage 134) and the exterior of the setting tool 130 acting on the piston area of the piston.

Note that when the collets 188 are released for displacement relative to the recess 190 and the sleeve assembly 170 contacts and displaces the setting sleeve 158 downward relative to the mandrel assembly 146, the member 186 initially displaces downwardly with the setting sleeve, since the lugs 178 are engaged in the recess 180. However, when the member 186 is displaced downwardly, the lugs 178 are eventually no longer radially outwardly supported by the diameter 184. At this point, the lugs 178 are permitted to radially inwardly retract out of engagement with the recess 180 and the springs 182 maintain the lugs in their radially inwardly retracted positions thereafter.

The mandrel assembly 146 is threadedly secured to the packer mandrel 156 by means of an attachment mechanism known to those skilled in the art as a Ratch-Latch® 174. The Ratch Latch® 174 includes a series of threaded collets 176 which are threadedly attached to the packer mandrel 156 as shown in FIG. 9E. This threaded attachment of the packer mandrel 156 to the mandrel assembly 146 permits an upwardly biasing force to be applied to the packer mandrel by the mandrel assembly while a downwardly biasing force is applied to the packer setting sleeve 158 by the sleeve assembly 170 as described above.

The packer 154 is set when the setting sleeve 158 is displaced downwardly relative to the packer mandrel 156 due to sufficient biasing forces being applied downwardly to the setting sleeve and upwardly to the mandrel. Thus, it will be readily appreciated that the setting sleeve retainer mechanism 138 prevents setting of the packer 154 by preventing displacement of the setting sleeve 158 relative to the mandrel assembly 146 until the sleeve assembly 170 has displaced downward, thereby permitting the collets 188 to be released from the recess 190. Furthermore, the sleeve assembly 170 is not displaced downwardly until fluid pressure is applied to the chamber 160, which fluid pressure is sufficiently greater than fluid pressure external to the setting tool 130 to shear the shear screws 172. And, since fluid pressure cannot be applied to the chamber 160 until the isolation sleeve 140 is displaced downwardly relative to the mandrel assembly 146, it will be readily appreciated that the packer 154 cannot be set until the ball 152 is sealingly engaged with the isolation sleeve and a fluid pressure differential applied is across the ball to shear the shear pins 148.

The circulation valve 136 is initially open to fluid flow therethrough before the packer 154 is set as described above. A series of ports 192 formed through the mandrel assembly 146 are in fluid communication with one or more ports 194 formed through a circulation sleeve 196 reciprocably disposed within the flow passage 134. The circulation sleeve 196 is releasably secured against displacement relative to the mandrel assembly 146 by one or more shear pins 198 installed through a sleeve 200 and into the circulation sleeve.

In its open position as representatively illustrated in FIG. 9D, the circulation valve 136 permits fluid to be circulated through the setting tool 130. This feature is highly advantageous when the setting tool 130 is attached to a packer having a temporary plug installed therein or otherwise preventing fluid flow therethrough and the wellbore has relatively heavy mud in it. The open circulation valve 136 permits the work string on which the setting tool 130 and packer 154 are conveyed to be filled automatically as the work string is run into the wellbore, without the need to periodically fill the tubing from the surface. The open circulation valve 136 also permits the mud to be periodically circulated through the setting tool 130 as the work string is lowered in the wellbore to prevent mud solids and debris from accumulating in the setting tool and packer 154. Additionally, the open circulation valve 136 prevents fluid from being trapped between the ball 152 and the temporary plug preventing fluid flow through the packer 154 when the isolation sleeve 140 is displaced downwardly to set the packer. Such trapped fluid could prevent sufficient downward displacement of the isolation sleeve 140, thereby preventing setting of the packer 154, or the trapped fluid could cause the temporary plug to be expelled prematurely.

The circulation valve 136 is closed by the isolation sleeve 140 when the isolation sleeve displaces downwardly relative to the mandrel assembly 146. The isolation sleeve 140 contacts the circulation sleeve 196, applies a sufficient downwardly biasing force to the circulation sleeve to shear the shear pins 198, and displaces the circulation sleeve downwardly relative to the mandrel assembly 146. Downward displacement of the circulation sleeve 196 eventually brings an external shoulder 202 formed on the circulation sleeve into contact with an internal shoulder 204 formed on the sleeve 200, preventing further downward displacement of the circulation sleeve relative to the mandrel assembly 146.

When the shoulders 202, 204 contact each other, seals 206 will straddle the ports 192, thereby preventing fluid flow through the ports 192. Thus, the circulation valve 136 is closed when the isolation sleeve 140 is downwardly displaced relative to the mandrel assembly 146. This permits the packer 154 to be pressure tested after it is set in a wellbore by applying fluid pressure at the earth's surface to an annulus formed between the work string and the wellbore.

Note that, after the isolation sleeve 140 has contacted the circulation sleeve 196 and displaced it downwardly to close the circulation valve 136, the seals 142 on the isolation sleeve enter an enlarged bore 208 formed in the mandrel assembly 146, permitting fluid to pass outwardly around the isolation sleeve from above the ball 152 to below the ball between the isolation sleeve and the bore 208, aided in part by a port 210 formed through the isolation sleeve below the seals. This is due to the fact that the seals 142 do not sealingly engage the bore 208.

However, the seals 142 are a sufficiently close fit in the bore 208, and the ball 152 remains sealingly engaged with the isolation sleeve preventing fluid flow axially therethrough, that a fluid pressure differential may be readily created across the isolation sleeve by flowing fluid into the flow passage 134 from above the ball 152. Thus, after the isolation sleeve 140 has been downwardly displaced sufficiently far to close the circulation valve 136, the packer 154 may still be set by applying fluid pressure to the flow passage 134 above the ball 152, even though the seals 142 do not sealingly engage the bore 208. Such sealing disengagement of the seals 142 is preferred so that the isolation sleeve 140 is pressure balanced after it has been downwardly displaced and neither the isolation sleeve nor the circulation sleeve 196 may be further displaced by application of fluid pressure to any portion of the setting tool 130 (the circulation sleeve is pressure balanced as well). However, it is to be clearly understood that it is not necessary for the seals 142 to be sealingly disengaged from the mandrel assembly 146, or for the isolation sleeve 140 or circulation sleeve 196 to be pressure balanced, in keeping with the principles of the present invention.

After the packer 154 has been set as described above, the setting tool 130 is disengaged from the packer and retrieved with the work string to the earth's surface. Disengagement of the setting tool 130 from the packer 154 may be accomplished by rotating the work string and setting tool from the earth's surface to unthread the collets 176 from the packer mandrel 156. Note that the collets 176 are prevented from rotating relative to the mandrel assembly 146 by structures 212 extending radially outward from the mandrel assembly between each adjoining pair of the collets. Upward displacement of the collets 176 when they are unthreaded from the packer mandrel 156 causes one or more shear pins 214 releasably securing the collets against axial displacement relative to the mandrel assembly 146 to shear, permitting the collets to displace upwardly relative to the mandrel assembly.

If, for whatever reason, it is not possible to unthread the collets 176 from the packer mandrel 156, an upwardly biasing force may be applied to the setting tool 130 by the work string, shearing the shear pins 214 and bringing the collets 176 into contact with a ring 216 disposed externally on the mandrel assembly 146. The ring 216 is releasably secured against displacement relative to the mandrel assembly 146 by a series of shear screws 218 installed through the ring and into the mandrel assembly.

When a sufficient upwardly biasing force is applied to the mandrel assembly 146, the shear screws 218 will shear, permitting the ring 216 and the collets 176 to displace downwardly relative to the mandrel assembly 146. Eventually, the collets 176 will no longer be radially outwardly supported by an outer diameter 220 formed on the mandrel assembly 146 and will flex radially inward out of engagement with the packer mandrel 156. The mandrel assembly 146 will then be permitted to displace upwardly relative to the packer mandrel 156, thereby releasing the setting tool 130 from the packer 154.

When the sleeve assembly 170 displaces downwardly relative to the mandrel assembly 146 to set the packer 154 as described above, an internal shoulder 226 thereon preferably does not contact or actuate a drain valve assembly 228 of the setting tool 130. The drain valve assembly 228 includes a sleeve 230 reciprocably disposed on the mandrel assembly 146 outwardly overlying and preventing fluid flow through a series of ports 232 formed through the mandrel assembly. The sleeve 230 is releasably secured against displacement relative to the mandrel assembly 146 by one or more shear screws 234 installed through the sleeve and into the mandrel assembly.

Seals 236 are carried on the mandrel assembly 146 and are sealingly engaged between the mandrel assembly and the sleeve 230 straddling the ports 232. One or more ports 238 are formed through the sleeve 230. When the sleeve 230 is downwardly displaced relative to the mandrel assembly 146 as described more fully below, the ports 238 are placed in fluid communication with the ports 232, thereby permitting fluid communication between the flow passage 134 and the exterior of the setting tool 130.

After the packer 154 is set and as the setting tool 130 is released from the packer as described above, the sleeve assembly 170 is permitted to displace further downward relative to the mandrel assembly 146, so that the shoulder 226 contacts a snap ring retainer 242 threadedly attached to the sleeve 230. Fluid pressure in the flow passage 134 (and, thus, also in the chamber 160) sufficiently greater than fluid pressure external to the setting tool 130 will cause the piston 162 to exert a downwardly biasing force on the sleeve assembly 170 and sleeve 230, thereby shearing the shear screws 234. The sleeve 230 is downwardly displaced by the biasing force until the ports 238 are placed in fluid communication with the ports 232 and a snap ring 240 carried between the sleeve 230 and the snap ring retainer 242 is received in an annular recess 244 formed externally on the mandrel assembly 146, preventing further displacement of the sleeve relative to the mandrel assembly. Such fluid communication between the flow passage 134 and the exterior of the setting tool 130 through the ports 232, 238 permits the work string to drain as the setting tool is retrieved to the earth's surface after setting the packer 154.

Seals 222 are carried on a lower portion of the mandrel assembly 146 for sealing engagement within the packer mandrel 156. The mandrel assembly 146 is provided with an internally threaded lower end connection 224 for attachment thereto of additional tools, equipment, etc., which may extend downwardly into or through the packer mandrel 156. Tubular members attached to the end connection 224 may be considered extensions of the mandrel assembly 146.

Referring additionally now to FIGS. 10A–M, a method 250 of underbalanced drilling and completion of a well is representatively and schematically illustrated. The method 250 permits a lower portion of a well to be selectively isolated from an upper portion of the well while drill strings and production strings are tripped in and/or out of the well, thereby enabling these operations to be performed safely. In addition, these operations are performed conveniently and economically, without requiring direct control of the selective isolation of the well portions from the earth's surface.

Figure 10A:
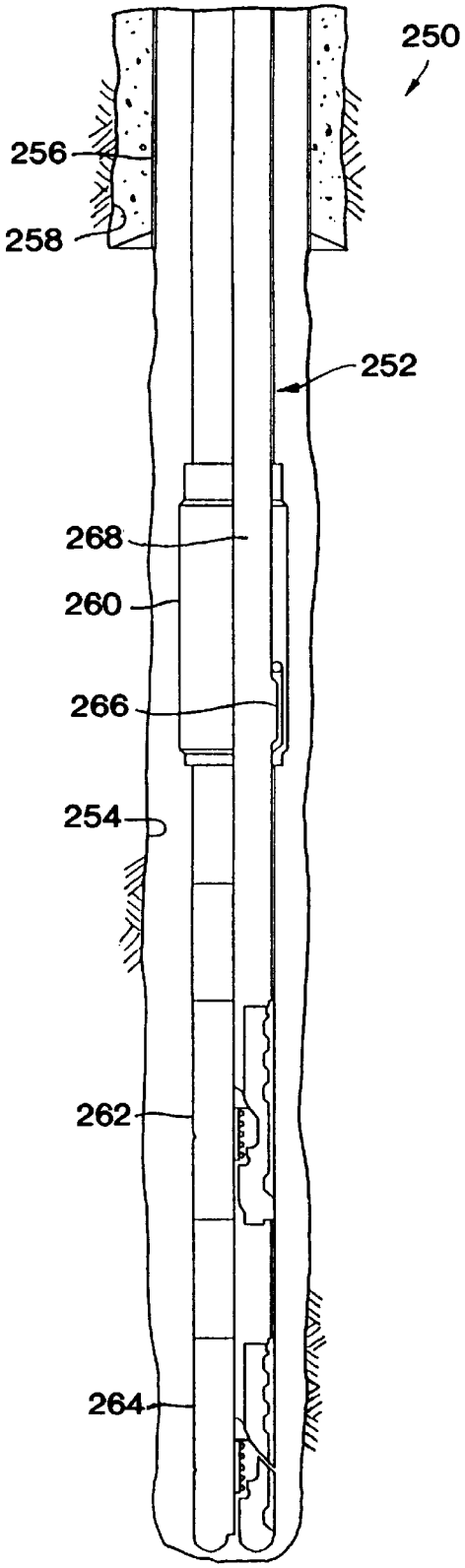
FIGS. 10A–M are schematic well diagrams showing a method of drilling and completing a subterranean well, the method embodying principles of the present invention.

In FIG. 10A, a string 252 of casing or liner is shown installed in a wellbore 254 extending downwardly from another, larger diameter, casing string 256 cemented within an upper wellbore 258. The casing string 252 thus extends downwardly into the lower wellbore 254 and upwardly into the casing string 256. The casing string 252 includes a valve 260, a conventional float collar 262 and a conventional float shoe 264. The casing string 252 may be suspended from the casing string 256 utilizing a conventional hanger or other anchoring device (not shown) and/or the casing string 252 may be bottomed in the wellbore 254.

The valve 260 selectively permits and prevents fluid flow therethrough and may be the well control valve 10 described above. However, a method incorporating principles of the present invention may be performed using a valve other than the well control valve 10 described above. The valve 260 shown in FIG. 10A includes a closure element 266, representatively a flapper-type closure element, for preventing fluid flow through a flow passage 268 extending axially through the casing string 252. Other types of closure elements may be utilized in the valve 260 without departing from the principles of the present invention. As shown in FIG. 10A, the valve 260 is in an open configuration, the flapper 266 permitting fluid flow through the flow passage 268.

Figure 10B:
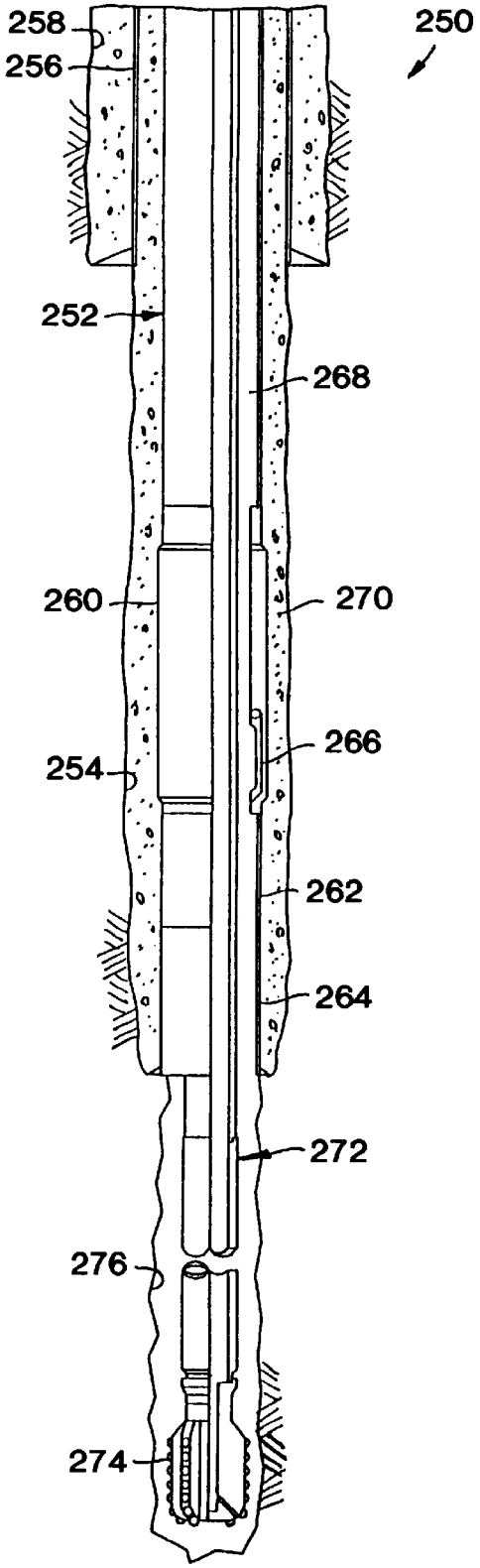

In FIG. 10B, it may be seen that the casing string 252 is cemented within the wellbore 254 and casing string 256. Preferably, the cement 270 is flowed downwardly through the casing string 252, out into the wellbore 254 outwardly surrounding the casing string 252 and upwardly into the annular area between the casing strings 252, 256. Additionally, it is preferred that the cement 270 be flowed past the interior of the valve 260, a conventional cement wiper plug (not shown) passing through the valve and landing in the float collar 262 to displace the cement column through the valve.

The float collar 262 and float shoe 264 are then drilled or milled through, including removal of any cement therein and therebetween. Thus, the float collar 262 and float shoe 264 are depicted in FIG. 10B as tubular portions of the casing string 252, and are not further referred to, apart from references to the casing string 252, in the description of the method 250 below.

A drill string 272, including a drill bit 274, is then lowered into the casing string 252. The drill string 272 is utilized to drill a wellbore 276 extending outwardly from the casing string 252. The drill bit 274, or other portion of the drill string 272, may carry a shifting device for operating the valve 260. The shifting device may be similar to the ring 34 and it may be carried on the drill bit 274 in a manner similar to the manner in which the ring 34 is carried on the drill bit 68 as shown in FIG. 2. The shifting device may operate the valve 260 in a manner similar to the manner in which the ring 34 is utilized to operate the valve 10 as described above, the ring causing the latch sleeve assembly 26 to operatively engage the operator sleeve assembly upon application of a sufficient downwardly biasing force thereto, and the ring being deposited in the latch sleeve assembly as the drill string 272 is conveyed downwardly through the valve, a sufficient downwardly biasing force being applied to the drill string to release the ring from the bit 274. However, it is to be clearly understood that other means of operating the valve 260 may be utilized in the method 250 without departing from the principles of the present invention.

Figure 10C:
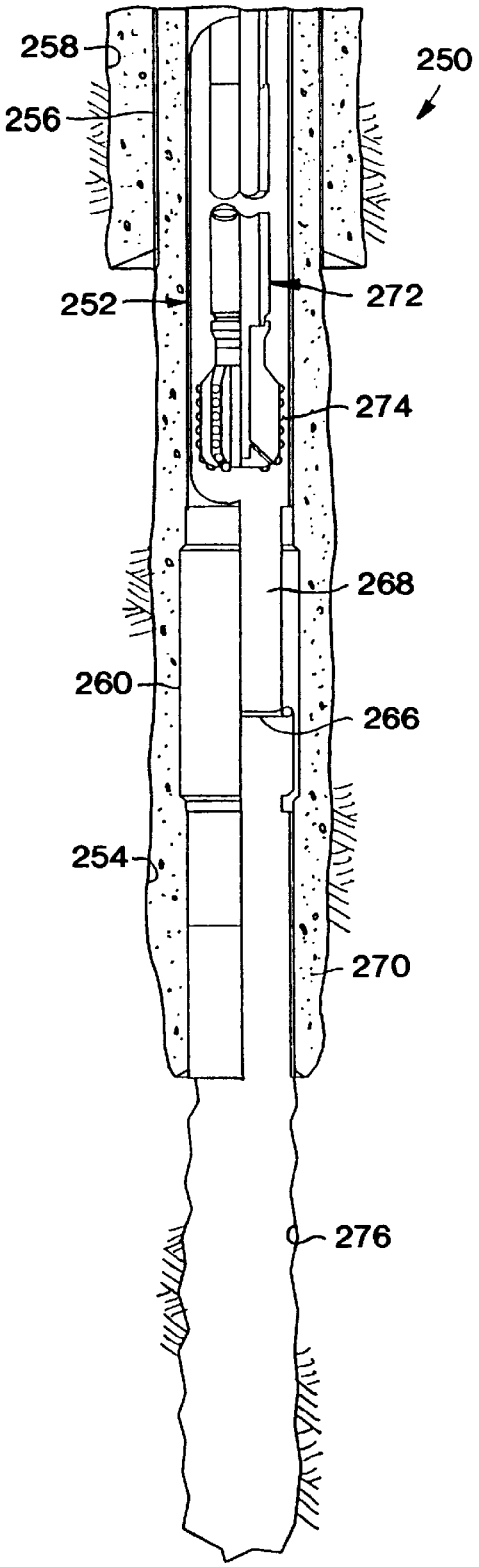

When the bit 274 needs to be replaced, the wellbore 276 has been completely drilled, or the drill string 272 is otherwise required to be retrieved from the well, the drill string is raised upwardly through the valve 260 as shown in FIG. 10C. Note that, at this point and in previous and subsequent operations in the wellbore 276, an underbalanced condition exists in the wellbore 276, for example, to prevent damage to, and fluid loss into, one or more earth formations intersected by the wellbore. Thus, when the drill string 272 is tripped out of the well, it is desired for the valve 260 to close, in order to prevent flowing of any fluids from the formation(s) intersected by the wellbore 276 upwardly through the flow passage 268, which could cause loss of control of the well.

If the valve 260 is the valve 10 described above, it closes automatically as the drill string 272 is raised upwardly therethrough. Specifically, the bit 274 engages the ring 34 or other shifting device, applies a sufficient upwardly biasing force to displace the latch sleeve assembly 26 and operator sleeve assembly 22 upward, and the ring is retrieved with the drill string 272 to the earth's surface. The valve 260 is shown in its closed position in FIG. 10C, the closure element 266 preventing fluid flow from the wellbore 276 upwardly through the flow passage 268.

Figure 10D:
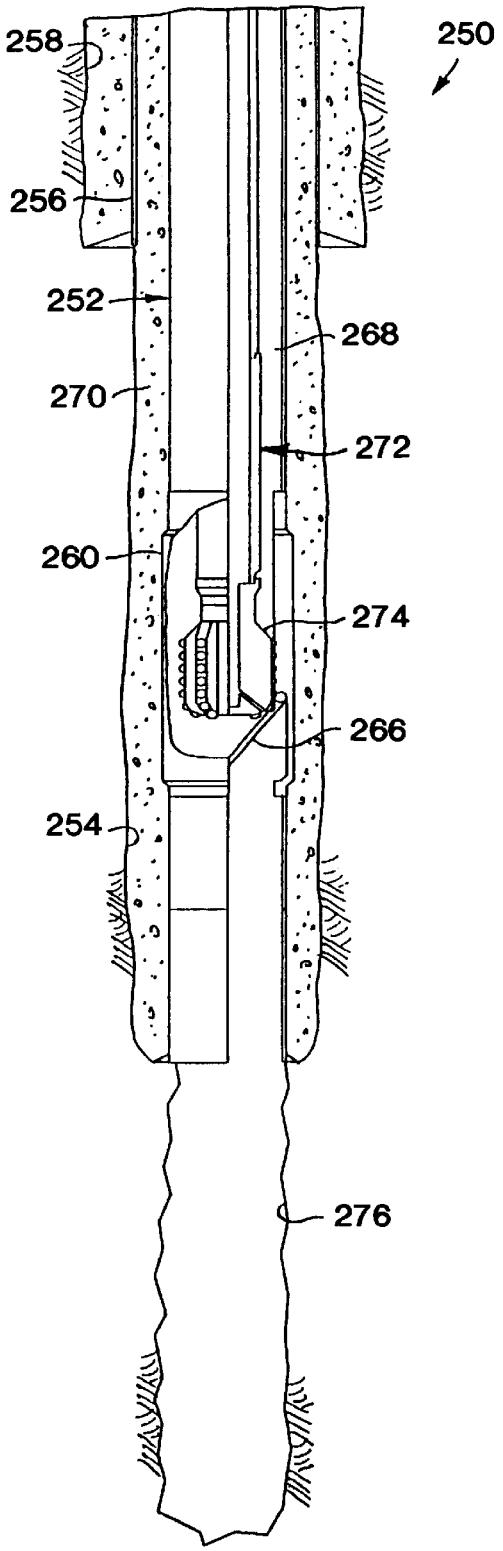

In FIG. 10D, the drill string 272 is shown being conveyed back into the wellbore 276 for further drilling thereof after replacement of the bit 274. If the valve 260 is the valve 10 described above, the bit 274 or other portion of the drill string 272 carries a shifting device, such as the ring 34, into the valve for opening the valve as the drill string passes therethrough. The ring 34 engages the latch sleeve assembly 26 and a sufficient downwardly biasing force is applied to the ring to downwardly displace the latch sleeve assembly and operator sleeve assembly 22, a sufficient downwardly biasing force is applied to the ring to release the ring from the drill bit 274, and the ring is deposited in the valve 260. Such downward displacement of the operator sleeve assembly 22 causes the valve 260 to open, permitting the drill string 272 to be conveyed downwardly therethrough.

Figure 10E:
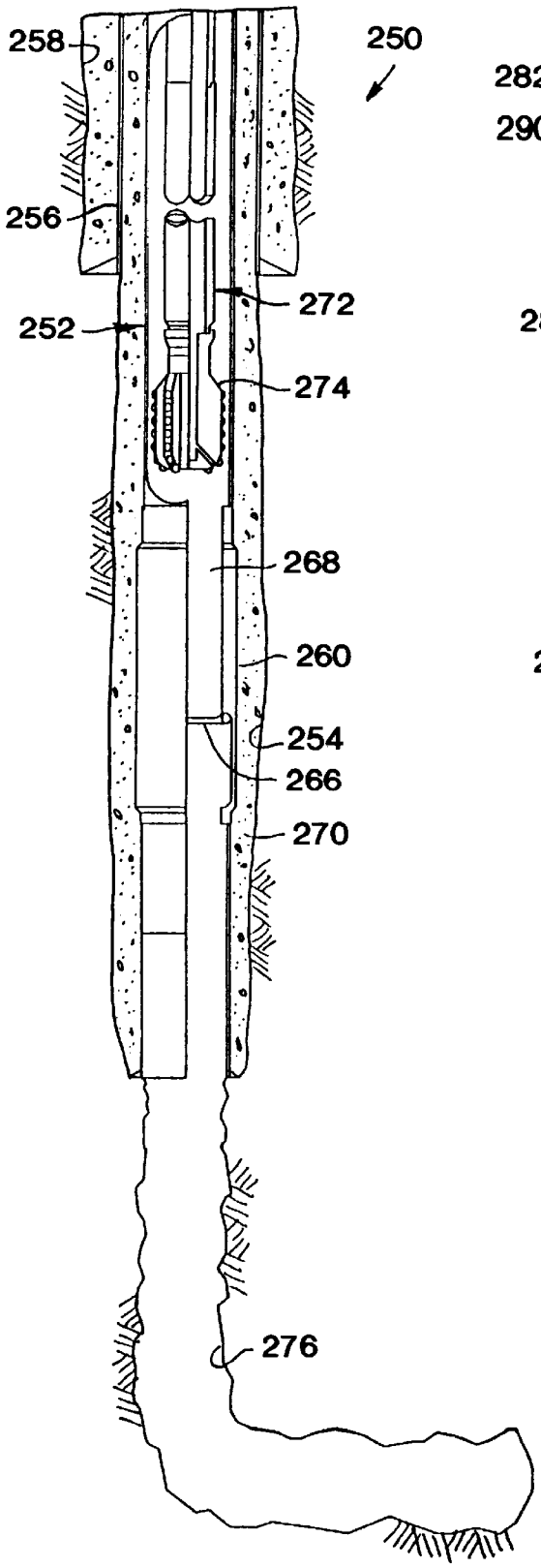

In FIG. 10E, the drill string 272 is shown being tripped out of the well after having further extended the wellbore 276. The valve 260 has been closed as the drill string 272 displaced upwardly therethrough as described above. Thus, it will be readily appreciated that the method 250 permits the drill string 272 to be repeatedly conveyed into and out of the wellbore 276, the valve 260 automatically opening as the drill string is conveyed downwardly therethrough, and the valve automatically closing as the drill string is conveyed upwardly therethrough. In this manner, the wellbore 276 may be maintained in an underbalanced condition while the drill string 272 is tripped in and out of the well, with no risk of loss of control of the well due to fluid flow from the wellbore 276 upwardly through the valve 260.

The extended wellbore 276 is shown in FIGS. 10E–M as being initially substantially vertical and then deviating to a substantially horizontal orientation, but it is to be clearly understood that the wellbore 276 may extend in various orientations, may be completely substantially vertical, may be completely substantially horizontal, etc., without departing from the principles of the present invention.

Figure 10F:
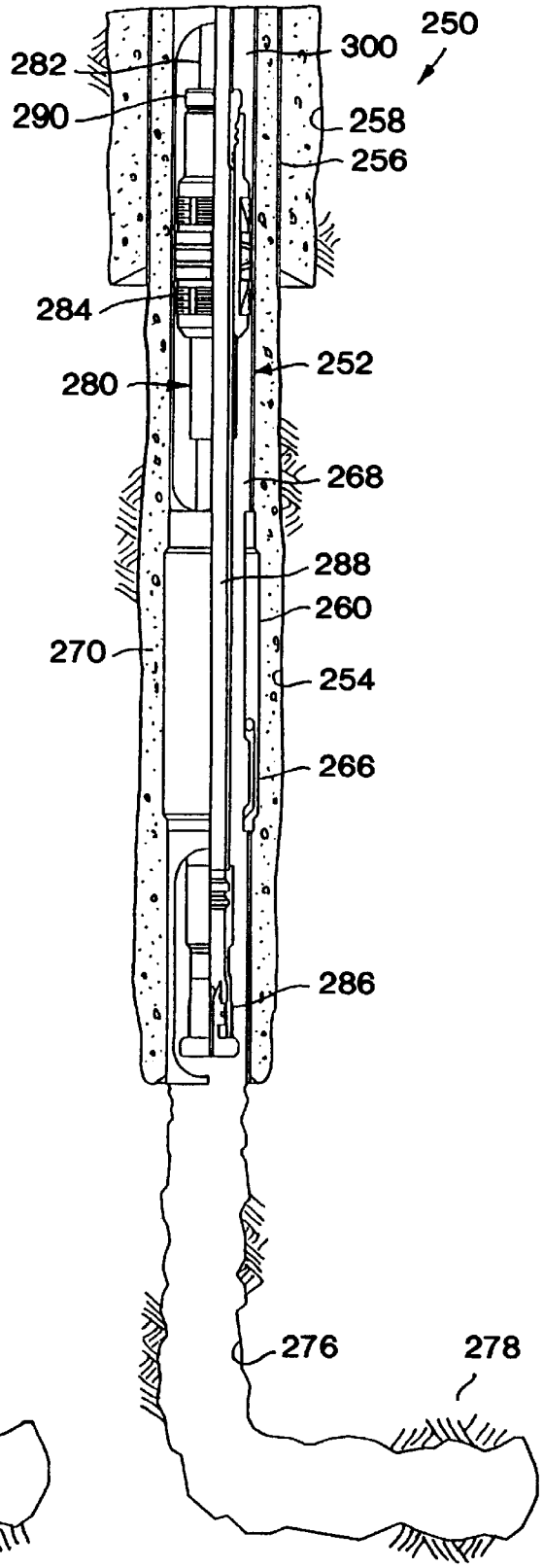

FIG. 10F shows initial steps in completing the well after the wellbore 276 has been drilled intersecting a formation 278 from which it is desired to produce fluids. Of course, a method incorporating principles of the present invention may be practiced wherein fluids are injected into the formation 278 as well.

A production assembly 280 is conveyed into the casing string 252 suspended from a tubular work string 282. The production assembly 280 includes a packer 284 and a plugging device 286. The plugging device 286 is a conventional device which permits fluid flow from an inner axial flow passage 288 of the production assembly 280 outwardly through the device by means of a float valve-type check valve therein, but which may be opened for unrestricted flow therethrough in either direction by installing a member, such as a ball, therein and applying fluid pressure to the flow passage 288 to expel the check valve. A plugging device of this type is available from Halliburton Energy Services, Inc., as Part No. 212oo7534. However, it is to be clearly understood that other plugging devices, and other types of plugging devices, may be utilized in the production assembly 280, without departing from the principles of the present invention.

A packer setting tool 290 is attached to the work string 282 and interconnected to the packer 284. The setting tool 290 may be the setting tool 130 described above, or it may be another setting tool. Use of the setting tool 130 for the setting tool 290 in the method 250 is preferred due to its features which include prevention of premature setting of the packer 284 and the ability to circulate therethrough prior to setting the packer.

The plugging device 286, or another portion of the production assembly 280 carries a shifting device for operating the valve 260. For example, if the valve 260 is the valve 10 described above, the ring 34 may be carried on the plugging device 286 in a manner similar to that in which the ring is carried on the bit 68 as shown in FIG. 2. As the production assembly 280 is conveyed through the valve 260, the shifting device engages the valve and opens it so that at least a lower portion of the production assembly including the plugging device 286 may be conveyed therethrough. For example, if the valve 260 is the valve 10, the ring 34 engages the latch sleeve assembly 26 and a sufficient downwardly biasing force is applied to the ring to downwardly displace the latch sleeve assembly and the operating sleeve assembly 22, thereby opening the flapper 266, and a sufficient downwardly biasing force is then applied to the production assembly to release the ring from the plugging device, the ring being thus deposited in the valve.

Alternatively, the production assembly 280 may include the opening tool 102 described above, or another tool, for opening the valve 260 as the production assembly is installed in the well. If the opening tool 102 is utilized, a shifting device, such as the ring 34, is not used and thus is not deposited in the valve 260. The opening tool 102 may be interconnected in the production assembly 280 below the plugging device 286.

The packer 284 is then set in the casing string 252 utilizing the setting tool 290. If the setting tool 290 is the setting tool 130 described above, the ball 152 is dropped and/or circulated down the work string 282 to the setting tool and a sufficient fluid pressure differential is applied to set the packer 284 as described above. For example, fluid pressure may be applied to the work string 282 at the earth's surface to create a pressure differential from the flow passage 288 to an annulus 300 formed between the work string and the wellbore 258.

After the packer 284 is set, the work string 282 and setting tool 290 are retrieved from the well. A conventional production tubing string (not shown) may then be conveyed into the well and sealingly engaged with and/or latched to the packer 284 in a conventional manner. The plugging device 286 may then be opened to permit flow from the formation 278 through the wellbore 276 upwardly through the flow passage 288 and into the production tubing string for transport to the earth's surface. Note that the method 250 permits the valve 260 to be automatically opened for production of fluids therethrough as the production assembly 280 is installed.

Figure 10G:
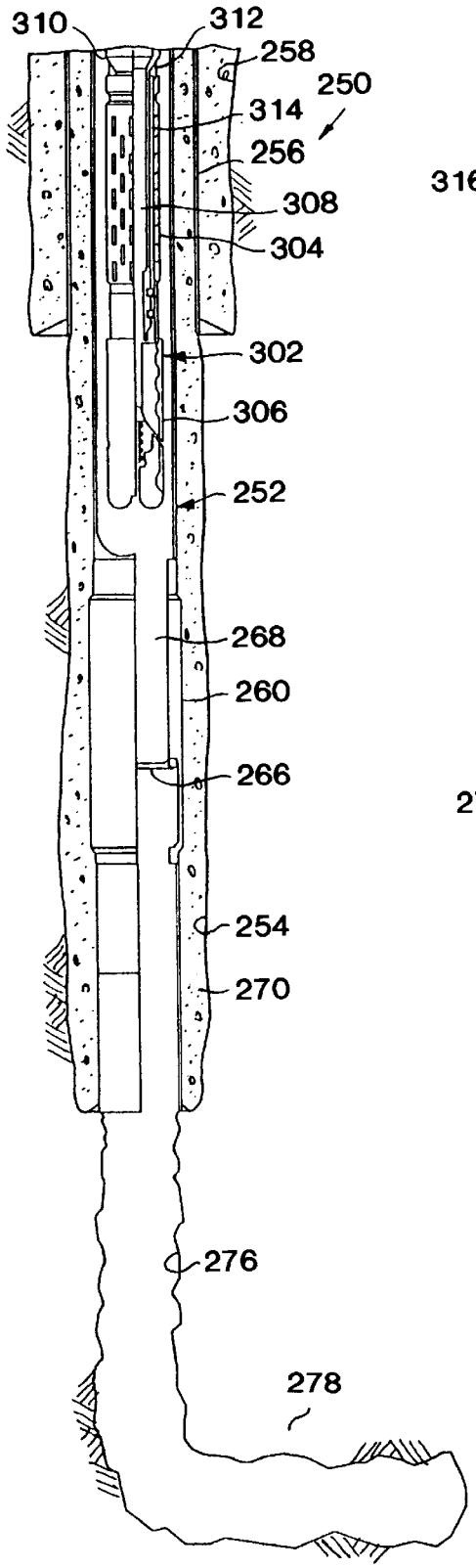

In FIG. 10G, an alternate production assembly 302 is installed in the well. The production assembly 302 includes a slotted liner 304 and a float shoe 306. The float shoe 306 prevents fluid flow into an inner axial flow passage 308 of the production assembly 302 while the production assembly is being installed, but permits circulation of fluid therethrough from the flow passage 308 to the flow passage 268.

The production assembly 302 is conveyed into the casing string 252 suspended from a tubular work string 310 which includes a conventional mechanical or hydraulic releasing tool 312 for releasing the slotted liner 304 from the work string 310. A wash pipe 314 extends downwardly from the releasing tool 312 within the slotted liner 304 and is sealingly engaged in the production assembly 302 below the slotted liner. The wash pipe 314 prevents fluid flow radially through the slotted liner 304 during installation of the production assembly 302.

The float shoe 306, or another portion of the production assembly 302, may carry a shifting device thereon for engaging and operating the valve 260, or an opening tool, such as the opening tool 102 described above, may be interconnected in the production assembly below the float shoe 306. As the production assembly 302 is displaced downwardly into the valve 260, the valve opens as described above, and the production assembly is displaced downwardly through the valve. The production assembly 302 is then released from the work string 310 by actuating the releasing tool 312. The work string 310, including the releasing tool 312 and the washpipe are then retrieved from the well.

Figure 10H:
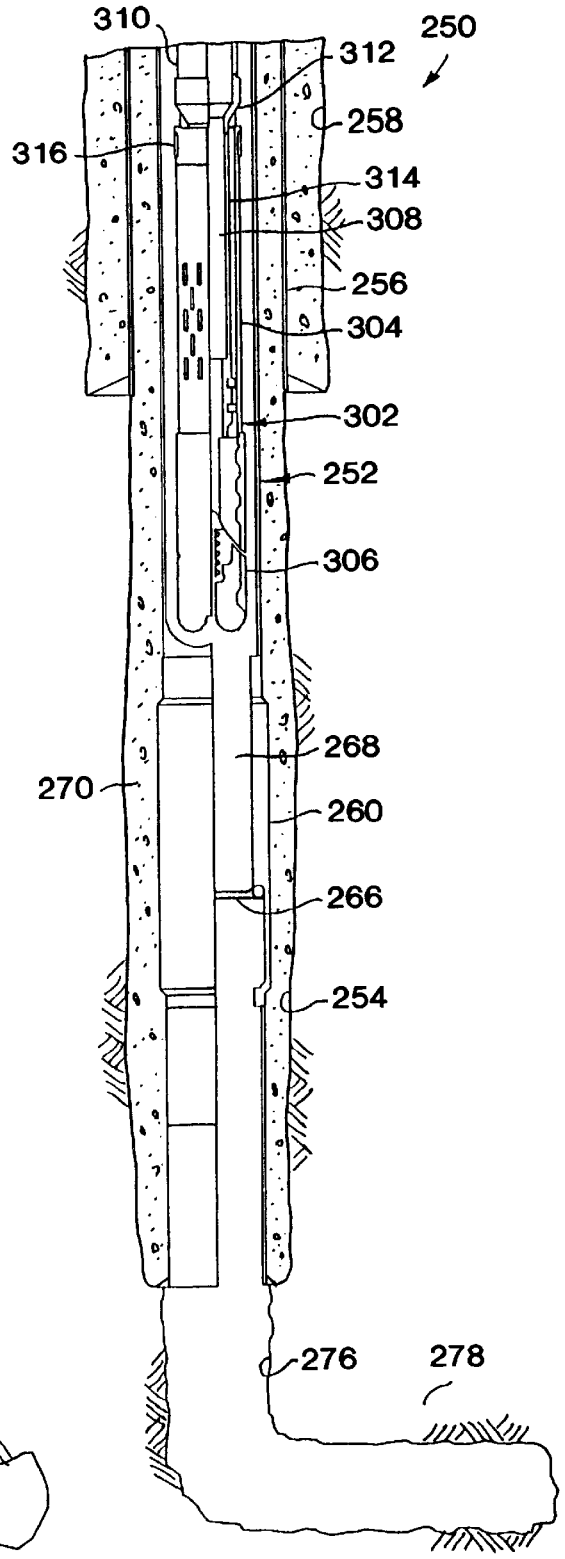
Figure 10I:
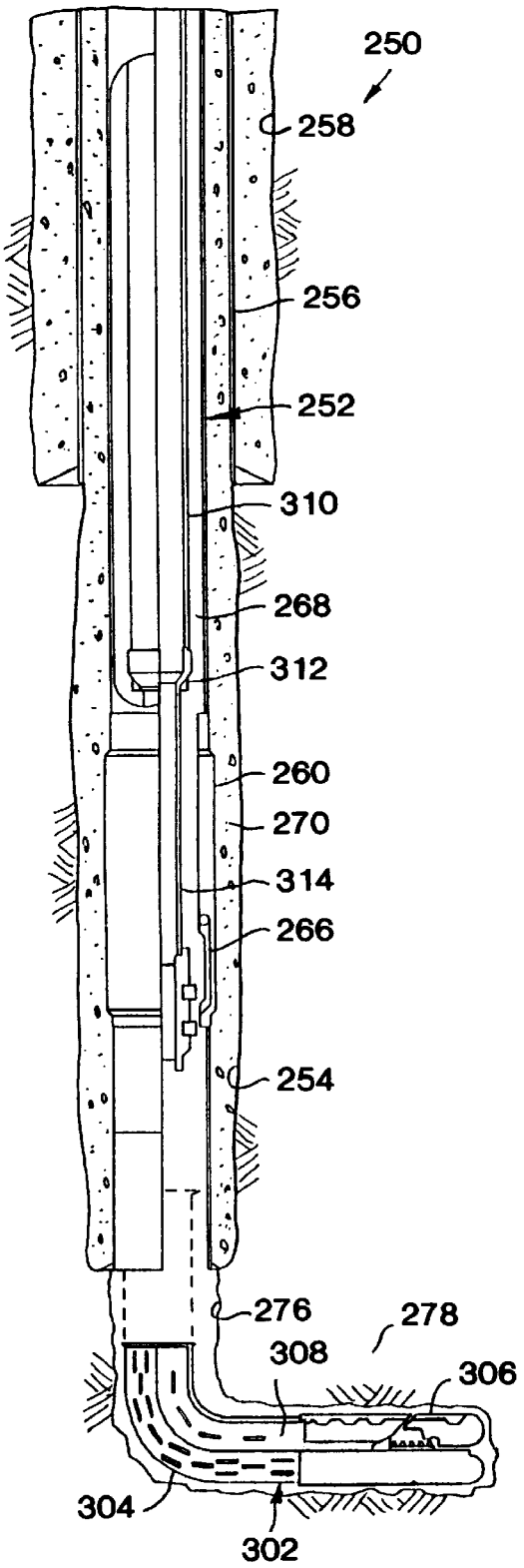

FIG. 10I depicts the method 250 after the production assembly 302 has been released from the work string 310. Note that an upper portion of the slotted liner 304 may be positioned in the wellbore 276 below the casing string 252, or it may extend upwardly into the casing string as shown in FIG. 10I in dashed lines. Fluid may now flow from the formation 278, into the slotted liner 304, into the casing string 252, and through the open valve 260.

As another alternative, the production assembly 302 may include a liner hanger 316 or other anchoring device attached to the slotted liner 304 as shown in FIG. 10H. The liner hanger 316 is set in the casing string 252 above or below the valve 260 after opening the valve as described above. FIG. 10M shows the production assembly 302 including the liner hanger 316 after the liner hanger has been set in the casing string 252 below the open valve 260 and after the work string 310 has been released from the production assembly. Note that, by setting the liner hanger 316 below the valve 260, the valve is still operable to selectively permit and prevent fluid flow through the flow passage 268. However, if it is desired to prevent subsequent operation of the valve 260, for example, to prevent inadvertent operation of the valve, the liner hanger 316 could be set in the casing string 252 above the valve.

After the production assembly 302 has been installed as shown in FIG. 10I or M, a conventional production tubing string (not shown) may be installed. For example, a production tubing string including a packer may be conveyed into the casing string 252 and the packer set in the casing string either above or below the valve 260. If the packer is set in the casing string 252 above the valve 260, the valve may still be operated. For example, the valve may be closed if it becomes necessary to retrieve the production tubing string from the well, or it is otherwise desired to isolate the wellbore 276 from the remainder of the well.

Figure 10J:
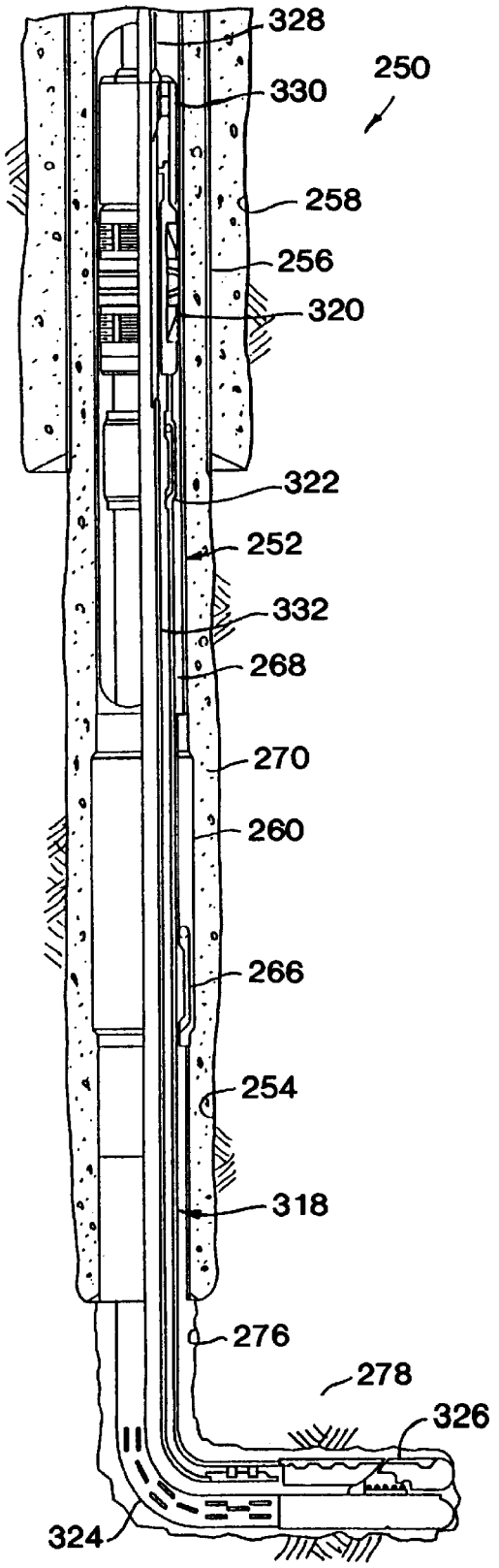
Figure 10K:
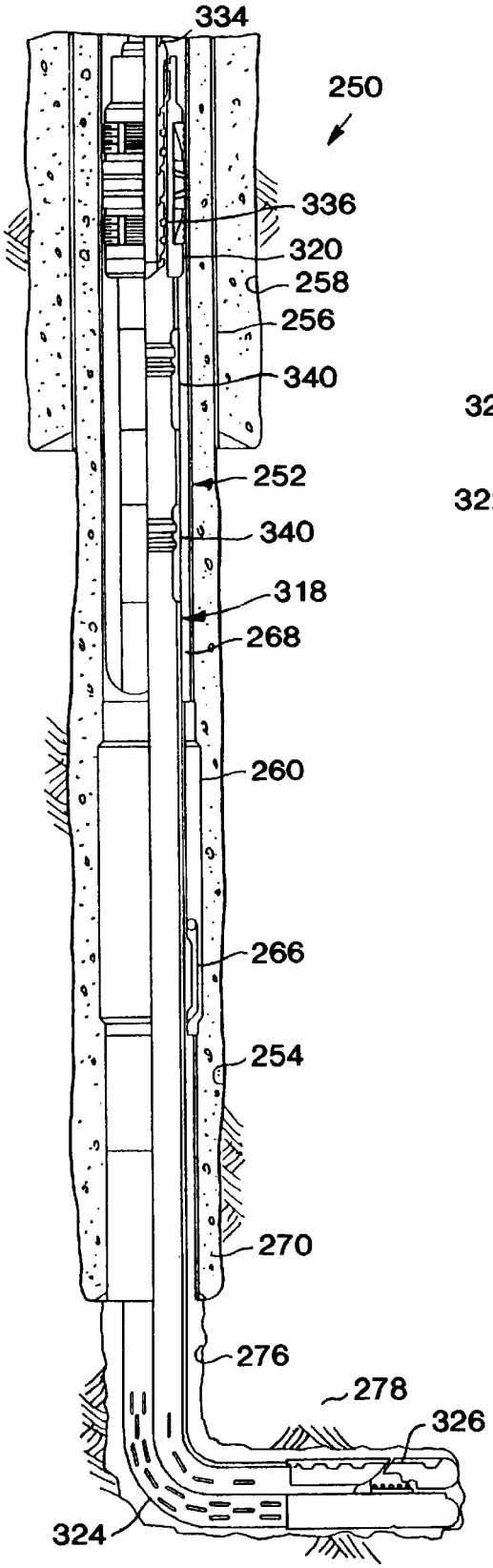

Another alternative production assembly 318 is shown in FIG. 10J for use in the method 250. The production assembly 318 includes a packer 320, a conventional flapper valve 322, a string of liner, including a slotted liner portion 324, and a float shoe 326. The production assembly 318 is conveyed into the well suspended from a work string 328, which includes a packer setting tool 330 and a washpipe 332. The washpipe 332 extends downwardly through the production assembly 318 and is sealingly engaged below the slotted liner portion 324, thereby preventing fluid flow radially through the slotted liner portion. The washpipe 332 also maintains the flapper valve 322 open while the production assembly 318 is installed in the well.

The production assembly 318 is installed by displacing the slotted liner portion 324 and float shoe 326 into the wellbore 276 and setting the packer 320 in the casing string 252 above the open valve 260. The valve 260 may be opened by a shifting device carried on the production assembly 318 or by an opening tool interconnected in the production assembly as described above. The packer 320 could be set below the valve 260 if it is desired to operate the valve 260 after installation of the production assembly 318.

The packer 320 is set utilizing the setting tool 330, which may be the setting tool 130 described above. The work string 328, including the setting tool 330 and washpipe 332, are then retrieved from the well. Note that when the washpipe 332 is removed from within the flapper valve 322, the flapper valve closes, thereby preventing fluid flow upwardly therethrough. This enables the work string 328 to be safely tripped out of the well without the danger of fluid flowing upwardly through the production assembly 318.

Figure 10L:
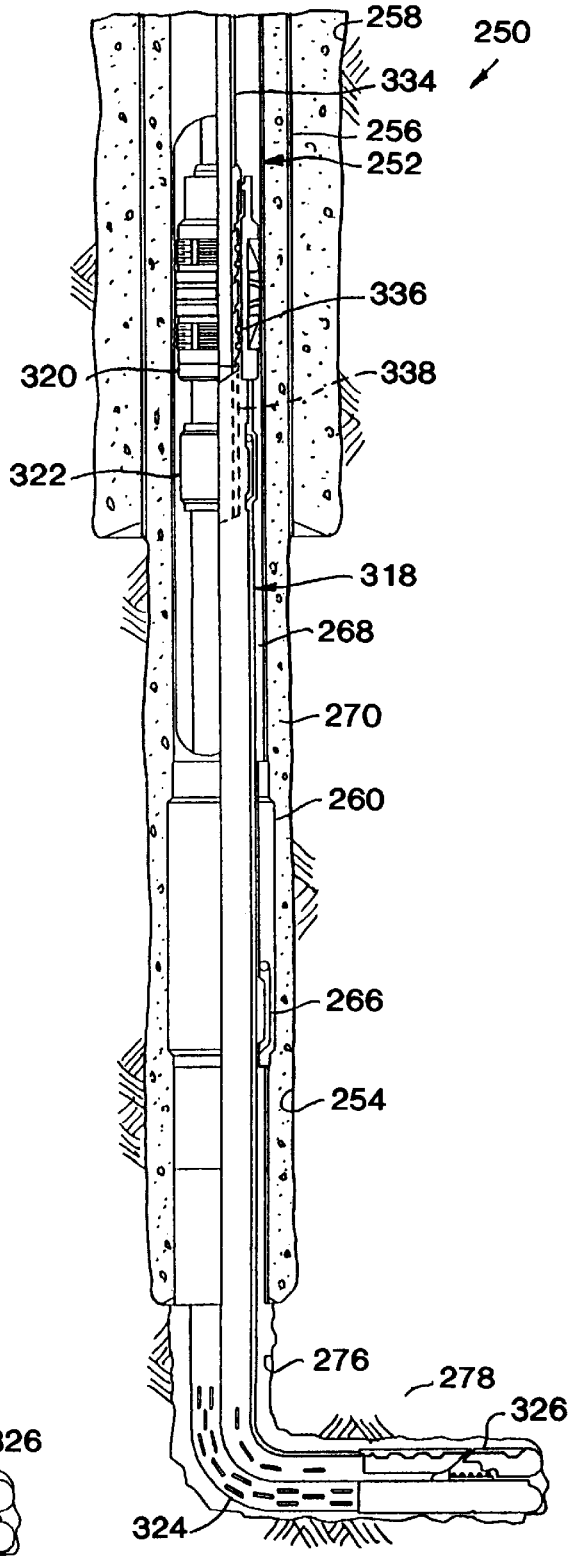
Figure 10M:
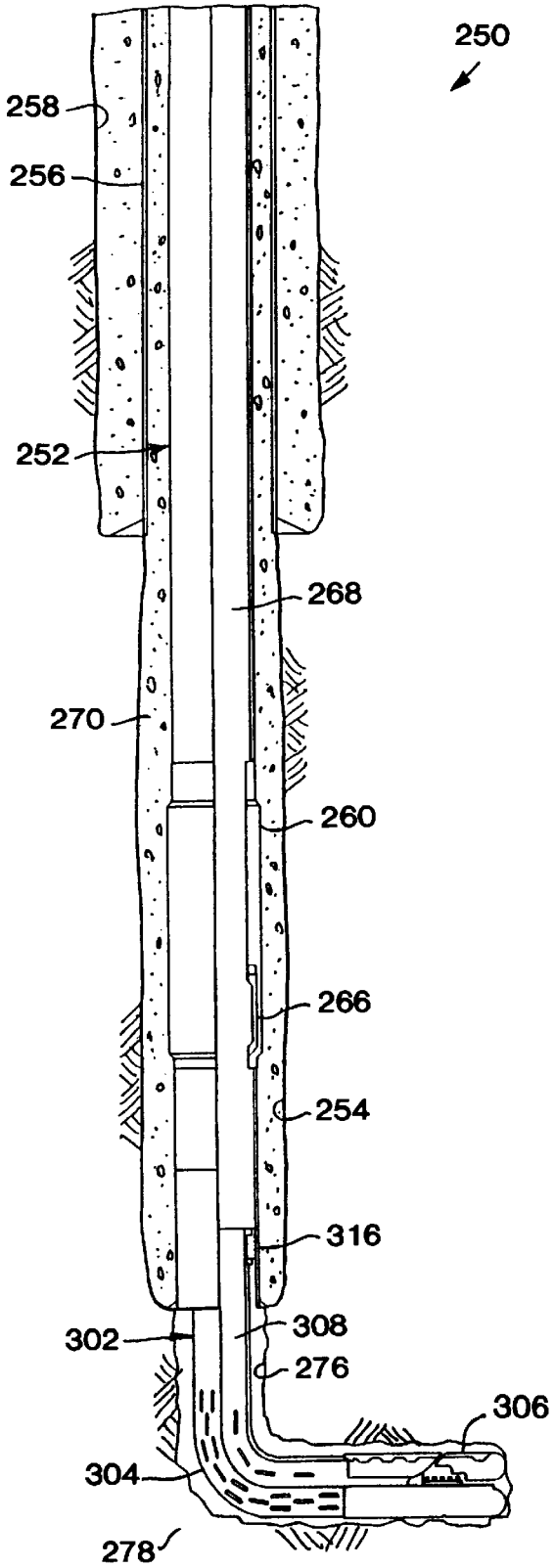

To produce fluids from the formation 278 after the production assembly 318 is installed, a production tubing string 334 including a conventional seal assembly 336 is engaged with the production assembly 318 as shown in FIG. 10L. The seal assembly 336 is sealingly engaged within the packer 320, so that fluid may flow from the formation 278 upwardly through the production assembly 318, and into the production tubing string 334 for transport to the earth's surface.

A tubular extension 338 (shown in FIG. 10L in dashed lines) may extend downwardly from the seal assembly 336 and into the flapper valve 322 to open the flapper valve when the seal assembly is installed in the packer 320. Alternatively, the flapper valve 322 could be another type of valve, such as a ball valve, in which case it may be opened by other means. If the valve 322 is a flapper valve, it may be Part No. 78oo415, and if it is a ball valve, it may be Part No. 12oo1394, both of which are available from Halliburton Energy Services, Inc. However, it is to be clearly understood that the valve 322 may be another type of valve, without departing from the principles of the present invention. If the valve 322 is a ball valve, the extension 338 may not be used in the method 250.

In FIG. 10K, the production assembly 318 is shown installed in the well, with the production tubing string 334 sealingly engaged therewith, similar to that shown in FIG. 10L. However, in FIG. 10K, the flapper valve 322 is replaced with one or more conventional nipples 340. The nipples 340 permit convenient installation therein of plugging devices or other flow control devices. For example, a conventional slickline or coiled tubing conveyed plugging device (not shown) may be installed in one of the nipples 340 if it becomes necessary to retrieve the production tubing string 334 from the well.

It will be readily appreciated by a person skilled in the art that the method 250 utilizing the valve 260 permits the wellbore 276 to be drilled and completed in an underbalanced condition. For example, during each of the valve opening and closing procedures described above in the method 250, the wellbore 276 may be maintained in an underbalanced condition, thereby preventing fluid flow from the wellbore into the formation(s) surrounding the wellbore.

Of course, many modifications, substitutions, deletions, additions, and other changes may be made to the various apparatus and methods described above, which changes would be obvious to one skilled in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of drilling a wellbore in a subterranean well, the method comprising the steps of:

positioning a valve in the well;

conveying a drill string and a shifting device releasably secured thereto into the well, opening the valve by engaging the shifting device with the valve;

then depositing the shifting device in the valve; and conveying the drill string through the open valve in a first direction, the shifting device remaining in the valve.

2. The method according to claim 1, wherein the positioning step further comprises interconnecting the valve in a tubular string.

3. The method according to claim 2, wherein the positioning step further comprises cementing the tubular string within the well.

4. The method according to claim 2, further comprising the step of drilling a wellbore extending outwardly from the tubular string after the positioning step.

5. The method according to claim 2, further comprising the step of maintaining the wellbore in an underbalanced condition during the valve opening step.

6. The method according to claim 1, further comprising the step of conveying the drill string from a wellbore drilled by the drill string through the open valve in a second direction opposite to the first direction, the drill string engaging the shifting device and displacing the shifting device therewith.

7. The method according to claim 6, further comprising the step of closing the valve by applying a biasing force to the shifting device with the drill string in the second direction.

8. The method according to claim 7, further comprising the step of maintaining the wellbore in an underbalanced condition during the valve closing step.

9. The method according to claim 1, wherein the step of conveying the drill string through the open valve further comprises conveying the drill string through the shifting device.

10. The method according to claim 1, wherein the depositing step further comprises retaining the shifting device relative to a receptacle in the valve.

11. The method according to claim 10, wherein the retaining step further comprises radially retracting a portion of the receptacle.

* * * * *